US005475229A

United States Patent [19]

Itabashi et al.

[11] Patent Number: 5,475,229

[45] Date of Patent: Dec. 12, 1995

[54] RADIOGRAPHIC INTENSIFYING SCREEN

[75] Inventors: Masamichi Itabashi; Yuichi Hosoi; Terumi Matsuda, all of Kanagawa, Japan

[73] Assignee: Fuji Photo Film Co., Ltd., Kanagawa, Japan

[21] Appl. No.: 295,477

[22] Filed: Aug. 25, 1994

Related U.S. Application Data

[63] Continuation of Ser. No. 81,701, Jun. 25, 1993, abandoned.

[30] Foreign Application Priority Data

Jul. 8, 1992 [JP] Japan ..... 4-206017
Mar. 9, 1993 [JP] Japan ..... 5-076364

[51] Int. Cl.[6] ..... G21K 4/00
[52] U.S. Cl. ..... 250/483.1
[58] Field of Search ..... 250/483.1, 486.1, 250/484.4

[56] References Cited

U.S. PATENT DOCUMENTS

| | | | |
|---|---|---|---|
| 4,090,085 | 5/1978 | Shimiya et al. | 250/483.1 |
| 4,835,396 | 5/1989 | Kitada et al. | 250/483.1 |
| 4,845,369 | 7/1989 | Arakawa et al. | 250/484.4 |
| 4,855,191 | 8/1989 | Arakawa et al. | 250/483.1 |
| 4,983,848 | 1/1991 | Hunter | 250/483.1 |
| 5,107,125 | 4/1992 | Powell et al. | 250/483.1 |
| 5,164,224 | 11/1992 | Kojima et al. | 250/483.1 X |
| 5,227,253 | 7/1993 | Takasu et al. | 250/483.1 X |

FOREIGN PATENT DOCUMENTS

| | | | |
|---|---|---|---|
| 102085 | 3/1984 | European Pat. Off. | 250/483.1 |
| 3-255400 | 11/1991 | Japan | 250/483.1 |

*Primary Examiner*—Carolyn E. Fields
*Assistant Examiner*—Edward J. Glick
*Attorney, Agent, or Firm*—Sixbey, Friedman, Leedom & Ferguson; Gerald J. Ferguson, Jr.; Thomas W. Cole

[57] ABSTRACT

An improvement of a radiographic intensifying screen comprises a support, a phosphor layer and a protective layer in order resides in the protective layer which is formed on the phosphor layer by coating a fluoro-resin on the phosphor layer to give a coated layer having a thickness of less than 5 μm.

7 Claims, 4 Drawing Sheets

RADIOGRAPHIC INTENSIFYING SCREEN

This application is a Continuation of Ser. No. 08/081, 701, filed Jun. 25, 1993, now abandoned.

BACKGROUND OF INVENTION

1. Field of the Invention

The present invention relates to a novel radiographic intensifying screen.

2. Description of Prior Art

In medical radiography, a radiographic image of the organ of patient is obtained by recording a pattern of X-rays having passed through the patient on a photographic material (silver halide photographic material) in which at least one photosensitive silver halide emulsion layer is provided on a transparent support by coating. Although the pattern of X-rays having passed through the patient can be obtained using a silver halide photographic material alone, a radiographic intensifying screen is usually employed in combination with the photographic material so as to avoid exposure of the objective human body to a large dose of X-rays. In a radiographic intensifying screen, provided on a support is a phosphor layer which absorbs X-rays and then converts them into the visible light to which the photographic material is sensitive. Therefore, the sensitivity of the system for X-ray photography can be remarkably improved by the use of a radiographic intensifying screen.

As a method for further enhancing the sensitivity of the system for X-ray photography, proposed was the method in which a photographic material having photographic emulsion layers provided on both sides, namely, a silver halide photographic material having silver halide photosensitive layers provided on both of the front and the back sides of the support, is used, and radiographic intensifying screens (which are sometimes referred to as "intensifying screens") are placed on both sides of said material to obtain an X-ray photography in this arrangement. At present, this method is generally used in most cases. This method has been proposed in view of the fact that sufficient amount of X-rays is not absorbed by the use of only one radiographic intensifying screen. In fact, even if content of the phosphor in one intensifying screen is increased in order to increase absorption of X-rays, the photographic material placed in contact with said intensifying screen receives very diffuse visible light emitted by said screen because the visible light converted within the phosphor layer is scattered and reflected in the phosphor layer having an increased thickness which is caused by the increase of the phosphor. In addition to that, the visible light converted within the deep area of the thick phosphor layer hardly comes out of the phosphor layer. Therefore immoderate increase of the phosphor content does not further increase the effective visible light emitted by the intensifying screen.

By the X-ray photographic system (i.e., radiography) using two intensifying screens each of which has a phosphor layer of adequate thickness, the total absorption of X-rays can be increased and the visible light converted in the intensifying screen can be efficiently used.

Commercially available are a variety of radiographic intensifying screens having different sensitivities in a wide range; for example, from the type of low sensitivity such as a screen that emits weak luminescence and gives an image of high sharpness (such screen has a relatively thin phosphor layer) to the type of high sensitivity such as a screen that emits high luminescence and gives an image of low sharpness (such screen has a relatively thick phosphor layer).

However, although various types of silver halide photographic materials having photographic emulsion layers provided on both sides are commercially available, their sensitivities vary within a narrow range. In fact, the sensitivities of the most photographic materials are only twice or three times as much as that of the least one (sensitivity of the lowest sensitive material is used as standard).

Employable combinations of silver halide photographic materials and intensifying screens used for radiography are not particularly restricted. However, when highly sensitive radiography is required (for example, in the case of radiography for lumbar vertebra, angiography for head or enlargement radiography), a combination of an intensifying screens of high emission and a silver halide photographic material of standard type or of high sensitivity is generally employed. In contrast, when high image quality is needed (for example, in the case of simple radiography of chest, gastric radiography using contrast medium, or radiography of bones), a combination of intensifying screens providing high sharpness and a silver halide photographic material of standard type is generally employed. While a combination of intensifying screens of high sensitivity and a silver halide photographic material gives an image of low sharpness (namely, low image quality), a combination of intensifying screens providing high image quality and a photographic material shows low sensitivity.

Previously, in order to establish an X-ray photographic system having excellent characteristics in balance between sensitivity and image quality, various studies have been continuously made. For instance, although a combination of intensifying screens having phosphor layers of calcium tungstate (which emits blue luminescence) and a silver halide photographic material which is not spectral sensitized (e.g., a combination of HIGH SCREEN STANDARD and RX [each of which is a tradename of Fuji Photo Film Co., Ltd.]) has been formerly used, a combination of intensifying screens having phosphor layers of terbium activated rare earth oxysulfide phosphor (which emits green luminescence) and a silver halide photographic material which is orthochromatically spectral sensitized (e.g., a combination of GREENEX 4 and RXO [each of which is a tradename of Fuji Photo Film Co., Ltd.]) has been recently used. The latter combination gives an image improved in both sensitivity and image quality.

A silver halide photographic material having photographic emulsion layers provided on both sides has a defect that the image quality is likely deteriorated by "crossover light". The word "cross-over light" means the visible light which is emitted by each intensifying screen placed on each side of the photographic material and then passes through the support of the photographic material (thickness of the generally used support is 170–180 μm) and finally reaches the photosensitive layer provided on the opposite side to deteriorate the image quality (particularly, in sharpness).

In order to reduce the cross-over light, various methods have been proposed. For example, U.S. Pat. Nos. 4,425,425 and 4,425,426 disclose inventions in which a spectral sensitized emulsion including tabular silver halide grains having a high aspect ratio is used as a silver halide photographic emulsion. According to these patented inventions, the cross-over light can be reduced to 15–22% level. Besides that, U.S. Pat. No. 4,803,150 discloses an invention in which a dye layer comprising fine crystalline dye particles and being decolorizable by the developing process is provided between the support and the photosensitive layers in the silver halide photographic material. It is described that cross-over light can be reduced to 10% level or less by the invention.

On the other hand, various attempts to provide an X-ray photographic system showing excellent characteristics in balance between the sensitivity and the image quality have been made by setting a combination of intensifying screens and a silver halide photographic material (which has photographic emulsion layers on both sides) under particular conditions. For example, Japanese Patent Provisional Publication Nos. 2(1990)-266344 and 2(1990)-297544 and U.S. Pat. No. 4,803,150 disclose an X-ray photographic system: in which the light property (sensitivity) of the front side combination (consisting of an intensifying screen placed on the side to be exposed [i.e., front screen] and a photosensitive layer [i.e., front photosensitive layer]) is made to differ from that of the back combination (consisting of an intensifying screen placed on the opposite side [i.e., back screen] and a photosensitive layer [i.e., back photosensitive layer]), and the contrast given by the former combination is made to differ from that given by the latter. In addition to that, *Photographic Science and Engineering*, vol. 26 (1982), No. 1, pp. 40, describes experiments about the combinations of intensifying screens and a silver halide photographic material each of which is available from 3M Co. The experiments show the result that a combination of Trimax 12 (tradename of intensifying screen commercially available from 3M Co.) and XUD (tradename of silver halide photographic material commercially available from 3M Co.) gives better NEQ (signal/noise ratio of output) than the combination of Trimax 4 (tradename of intensifying screen commercially available from 3M Co.) and XD (tradename of silver halide photographic material commercially available from 3M Co.), while the former is at the same level of the latter with respect to sensitivity and sharpness (MTF). It further describes that the above result is caused by the facts that XUD exhibits higher sharpness than XD and that Trimax 12 absorbs more amount of X-rays than Trimax 4.

As is described above, various methods have been proposed to establish X-ray photographic system showing excellent characteristics in balance between the sensitivity and the image quality. However, previously proposed radiographic image forming methods still do not satisfy the sensitivity and the image quality required, for instance, for X-ray photographic system to be used for diagnosis of stomach or chest. Actually, while it is very important to observe veins in lung to the minutest details in diagnosis for chest, satisfactory observation can not be made by the known X-ray photographic systems. Since the known systems often give radiographic images having poor contrast of the vein image, image qualities are deteriorated in respect of grains, or blur. Further, in diagnosis for stomach, diagnostically satisfactory radiographic images in well picturing the gastric wall cannot obtained.

Needless to say, if other conditions are neglected, a radiographic image of high quality can be obtained by a combination of a silver halide photographic material of low sensitivity and radiographic intensifying screens of low sensitivity. However, if such low-sensitive combination is used, the exposure (dose) of X-rays applied to human body should be naturally increased. Therefore, such combination is not practically applicable, and particularly, in the case of group examination in which it is required to reduce the dose of X-rays to be applied as much as possible.

SUMMARY OF THE INVENTION

An object of the present invention is to provide a novel radiographic intensifying screen which shows high durability and employable for obtaining a radiographic image of high quality.

Another object of the invention is to provide a radiographic intensifying screen which is favorably employable in a novel X-ray photographic system exhibiting excellent characteristics in balance between the sensitivity and the quality of the obtained radiographic image.

The present invention resides a radiographic intensifying screen comprising a support, a phosphor layer and a protective layer in order, wherein the protective layer is formed on the phosphor layer by coating a fluoro-resin on the phosphor layer to give a coated layer having a thickness of less than 5 μm.

The protective layer of the radiographic intensifying screen of the invention is preferably formed on the phosphor layer by coating a solution of the fluoro-resin in an organic solvent and evaporating the solvent to give a coated layer having a thickness of less than 5 μm.

The radiographic intensifying screen of the invention is preferably prepared to absorb X-rays of 80 $KV_p$ in an amount of not less than 25% and show contrast transfer function (CTF) values of at least 0.79 and at least 0.36 at spatial frequencies of 1 lp/mm and of 3 lp/mm, respectively.

DETAILED DESCRIPTION OF INVENTION

Figure 1:
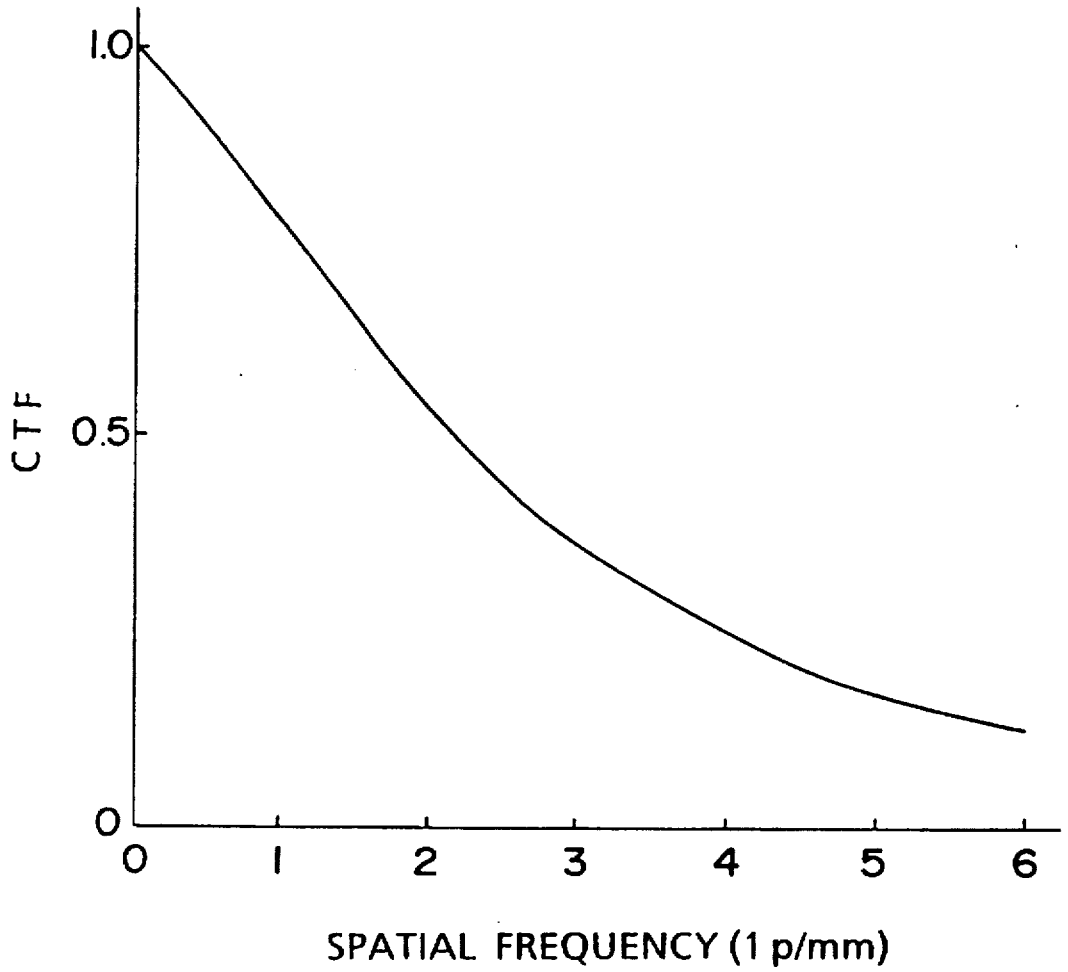
FIG. 1 shows a relation between spatial frequency (lp/mm) and contrast transfer function (CTF) with respect to the radiographic intensifying screen of the invention.

The radiographic intensifying screen of the present invention shows a high CTF (contrast transfer function) value and gives improved resistance to stain. For this reason, the radiographic intensifying screen of the invention is particularly advantageous in its repeated use.

Further, the radiographic intensifying screen of the invention gives a high sensitivity and a radiographic image of high sharpness if it is used in combination of a silver halide photographic material having a specific sensitivity. In this combination, a radiographic image having high recognizability can be obtained without increasing the dose of X-rays to which a human boy is exposed. Consequently, the radiographic intensifying screen of the invention is very advantageous for improving the precision of medical diagnosis.

The following is detailed explanation of the radiographic intensifying screen of the invention.

The radiographic intensifying screen consists essentially of a support and a phosphor layer provided thereon. The phosphor layer comprises a binder and phosphor particles dispersed therein. Further, a transparent film is provided on the free surface (surface which is not in contact with the support) of the phosphor layer to keep the phosphor layer from chemical deterioration and physical shock.

A preferred phosphor for the radiographic intensifying screen of the invention is a phosphor represented by the following formula:

$$M_{(w-n)}M'_nO_wX$$

in which M is at least one metal selected from the group consisting of Y, La, Gd and Lu; M' is at least one rare earth element, preferably one rare earth element being selected from the group consisting of Dy, Er, Eu, Ho, Nd, Pr, Sm, Ce, Tb, Tm and Yb; X is an intermediate chalcogen (i.e., S, Se or Te) or a halogen; "n" is a number satisfying the condition of $0.0002 \leqq n \leqq 0.2$; and "w" is 1 when "X" is a halogen, or is 2 when "X" is a chalcogen.

The concrete examples of phosphor preferably used for the radiographic intensifying screen of the invention are given below:

terbium activated rare earth oxysulfide phosphors such as $Y_2O_2S$:Tb, $Gd_2O_2S$:Tb, $La_2O_2S$:Tb, $(Y,Gd)_2O_2S$:Tb, and $(Y,Gd)_2O_2S$:Tb,Tm;

terbium activated rare earth oxyhalide phosphors such as LaOBr:Tb, LaOBr:Tb,Tm, LaOCl:Tb, LaOCl:Tb,Tm, GdOBr:Tb, and GdOCl:Tb; and thulium activated rare earth oxyhalide phosphors such as LaOBr:Tm and LaOCl:Tm.

A particularly preferred phosphor for the radiographic intensifying screen of the invention is the terbium activated gadolinium oxysulfide phosphor. There are detailed descriptions about terbium activated gadolinium oxysulfide phosphors in U.S. Pat. No. 3,725,704.

The phosphor layer comprises a binder and phosphor particles dispersed therein. The phosphor layer is generally provided on a support under an atmospheric pressure utilizing the following coating procedure.

The phosphor particles and the binder are mixed in an appropriate solvent to prepare a coating dispersion. The coating dispersion is directly applied onto a surface of a support for radiographic intensifying screen under an atmospheric pressure using a doctor blade, roll coater, knife coater or the like, and the solvent contained in the coating dispersion is removed to form a phosphor layer. Alternatively, the phosphor layer is placed on the support by the steps of applying the coating dispersion on a false support under an atmospheric pressure to form a phosphor sheet, peeling off the sheet from the false support, and then causing the sheet to adhere to a genuine support.

Preferred is a radiographic intensifying screen in which the phosphor density is increased (that is, void volume of the phosphor layer is lowered) by compressing the phosphor layer containing the below-described thermoplastic elastomer as a binder.

The sensitivity of the radiographic intensifying screen is essentially determined by the total amount of emission given by the phosphor contained therein, and the total amount of emission varies depending upon not only the emission luminance of the phosphor per se but also the content (i.e., amount) of the phosphor in the phosphor layer. The large content of the phosphor also results in increase of absorption of a radiation such as X-rays, so that the screen shows high sensitivity and provides an image of improved quality, especially in graininess. On the other hand, assuming that the content of the phosphor layer is kept at the same level, an intensifying screen utilizing such a phosphor layer provides an image of high sharpness if the phosphor layer is densely packed with the phosphor, because such phosphor layer can be made thinner to reduce spread of stimulating rays which is caused by scattering within the phosphor layer.

The above-mentioned radiographic intensifying screen is preferably prepared by a process comprising the steps of:

a) forming a phosphor sheet comprising a phosphor and a binder, b) placing said phosphor sheet on a support, then compressing and affixing simultaneously said phosphor sheet on said support at a temperature not lower than softening point or melting point of said binder.

In the first place, Step a) is described below.

A phosphor sheet for a phosphor layer of the radiographic intensifying screen can be prepared in the process which comprises applying the coating dispersion (i.e., binder solution in which the phosphor particles are uniformly dispersed) onto a false support, drying the coated film and peeling off the film to obtain the phosphor sheet (film).

Initially, the phosphor particles and the binder are mixed and stirred in an appropriate solvent to prepare a coating dispersion comprising the phosphor particles homogeneously dispersed in a binder solution.

As the binder, a thermoplastic elastomer of which softening point or melting point is in the range of 30°–150° C. is used alone or in combination with other binder polymers. The destruction of the phosphor particles in a compression treatment can be avoided by the use of the thermoplastic elastomer, because it has elasticity at room temperature and has fluidity when it is heated. Examples for the thermoplastic elastomers include; polystyrene, polyolefin, polyurethane, polyester, polyamide, polybutadiene, ethylene-vinyl acetate, polyvinyl chloride, natural rubber, fluorocarbon rubber, polyisoprene, chlorinated polyethylene, styrene-butadiene rubber and silicone rubber.

If the ratio of amount of the thermoplastic elastomer to the total binder is kept within the range of 10–100 wt. %, the effect of the invention can be achieved. However, the binder preferably includes the thermoplastic elastomer as much as possible, and therefore it is most preferred that the binder comprises thermoplastic elastomer in its 100 wt. % content.

Examples of the solvents employable in the preparation of the dispersion include lower aliphatic alcohols such as methanol, ethanol, n-propanol and n-butanol; chlorinated hydrocarbons such as methylene chloride and ethylene chloride; ketones such as acetone, methyl ethyl ketone and methyl isobutyl ketone; esters of lower aliphatic alcohols with lower aliphatic acids such as methyl acetate, ethyl acetate and butyl acetate; ethers such as dioxane, ethylene glycol monoethyl ether and ethylene glycol monomethyl ether; and mixtures of the above-mentioned solvents.

The ratio between the binder and the phosphor in the coating solution may be determined according to the characteristics of the aimed radiographic intensifying screen and the nature of the employed phosphor. Generally, the ratio therebetween is in the range of 1:1 to 1:100 (binder:phosphor, by weight), preferably in the range of 1:8 to 1:40, by weight.

The coating solution may contain various additives such as a dispersing agent to improve dispersibility of the phosphor particles therein and a plasticizer to increase the bonding between the binder and the phosphor particles in the resulting phosphor layer. Examples of the dispersing agent include phthalic acid, stearic acid, caproic acid and a hydrophobic surface active agent. Examples of the plasticizer include phosphates such as triphenyl phosphate, tricresyl phosphate and diphenyl phosphate; phthalates such as diethyl phthalate, and dimethoxyethyl phthalate; glycolates such as ethylphthalyl ethyl glycolate and butylphthalyl butyl glycolate; and polyesters of polyethylene glycols with aliphatic dicarboxylic acids such as polyester of triethylene glycol with adipic acid and polyester of diethylene glycol with succinic acid.

The coating dispersion containing the phosphor and the binder prepared as above is applied evenly onto a surface of a support to form a layer of the coating dispersion. The coating procedure can be carried out by a conventional method such as a method using a doctor blade, a roll coater or a knife coater.

A false support material employable in the invention can be selected from those employed in the conventional radiographic intensifying screens such as glass plate and metal plate. Examples of the support material include plastic films such as films of cellulose acetate, polyester, polyethylene terephthalate, polyamide, polyimide, triacetate and polycarbonate; metal sheets such as aluminum foil and aluminum alloy foil; ordinary papers; baryta paper; resin-coated papers; pigment papers containing titanium dioxide or the like; papers sized with polyvinyl alcohol or the like; and ceramic sheets such as sheets of alumina, zirconia, magnesia and titania.

The process for preparation of the phosphor sheet comprises the steps of applying the coating dispersion onto a false support, drying the coated film and peeling off the film to obtain the phosphor sheet for the phosphor layer of the radiographic intensifying screen. Therefore, the surface of the false support preferably is beforehand coated with a release agent so that the film may be easily peeled off.

In the second place, Step b) is described below.

A support for a radiographic intensifying screen is prepared. The support can be freely selected from the same materials as the material for the false support used in preparation of the phosphor sheet.

In the preparation of a known radiographic intensifying screen, one or more additional layers are occasionally provided between the support and the phosphor layer, so as to enhance the adhesion between the support and the phosphor layer, or to improve the sensitivity of the screen or the quality of an image (sharpness and graininess) provided thereby. For example, a subbing layer or an adhesive layer may be provided by coating a polymer material such as gelatin over the surface of the support on the phosphor layer side. Otherwise, a light-reflecting layer or a light-absorbing layer may be provided by forming a polymer material layer containing a light-reflecting material such as titanium dioxide or a light-absorbing material such as carbon black. In the invention, one or more of these additional layers may be provided on the support, and the constitution thereof can be optionally selected depending upon the purpose of the radiographic intensifying screen.

The phosphor sheet prepared in Step a) is placed on a support, and then compressed and affixed simultaneously on the support at a temperature of not lower than softening point or melting point of the binder.

In this process, the phosphor sheet is not beforehand fixed on a support but simultaneously compressed and affixed on the support. Therefore, the pressure extends throughout the sheet and the destruction of the phosphor particles can be avoided. Moreover, assuming that the pressure applied to the sheet is kept at the same level, the sheet simultaneously compressed and affixed on the support has higher packing ratio of the phosphor than that of the sheet which is beforehand fixed on the support and subjected to compression treatment.

Examples of the compressing apparatus for the compression treatment include known apparatus such as a calender roll and a hot press. For instance, a compression treatment using a calender roll involves moving the phosphor sheet prepared in Step a) on a support to pass through between two rollers heated at a temperature not lower than softening point or melting point of the thermoplastic elastomer of the binder. The compressing apparatus employable in the invention is not restricted to them. Any other apparatuses can be employed so long as they can compress a sheet such as the above-stated one under heating.

The pressure for compression preferably is not less than 50 $kgw/cm^2$.

A radiographic intensifying screen generally has a transparent film on the free surface of the phosphor layer to physically and chemically protect the phosphor layer. In the intensifying screen of the present invention, it is preferred to provide a transparent film for the same purpose.

The protective film of the radiographic intensifying screen of the invention is a transparent synthetic resin layer having the thickness of not more than 5 μm. Such a thin protective layer contributes to improving the sharpness of the obtained radiographic image, because it shortens the distance between the silver halide photographic material and the phosphor on the radiographic intensifying screen.

The protective film for the radiographic intensifying screen preferably is a film formed from a solution containing fluoro-resin soluble in an organic solvent. The fluoro-resin is a polymer of an olefin having fluorine (i.e., fluoroolefin) or a copolymer using an olefin monomer having fluorine as a copolymer component. The film formed from the fluoro-resin solution may be cross-linked. The protective film of fluor-resin is advantageous because stain (caused by, for instance, the plasticizer and the like exuding from radiographic films or other materials in contact with the protective film) hardly permeates the film and the stain can be easily removed by wiping.

In the case that fluoro-resin soluble in organic solvents is used as the material for forming a protective film, the film can be easily formed by the steps of applying a solution of the resin dissolved in a proper organic solvent and drying the coated solution in the same manner described above. Actually, the protective film can be formed by the steps of evenly coating the surface of the phosphor layer with a solution for forming a protective film containing the fluoro-resin soluble in organic solvents by a doctor blade or the like, and drying the coated solution. The protective film and the phosphor layer can be formed at the same time by simultaneous superposing coating method.

The fluoro-resin is a polymer of an olefin having fluorine (fluoroolefin) or a copolymer of an olefin having fluorine as a copolymer component. Examples of the fluoro-resins include polytetrafluoroethylene, polychlorotrifluoroethylene, polyvinyl fluoride, polyvinylidene fluoride, tetrafluoroethylene-hexafluoropropylene copolymer and fluoroolefin-vinyl ether copolymer. The fluoro-resin is generally insoluble in organic solvents, but the resin comprising a fluoroolefin as a copolymer component is soluble in organic solvents provided that other copolymer components (other than fluoroolefin) are appropriately selected. Therefore, by the steps of dissolving such resin into an appropriate solvent, applying the obtained solution onto the phosphor layer and drying the applied solution, the protective film can be easily formed. An example of such copolymer is fluoroolefin-vinyl ether copolymer. Polytetrafluoroethylene and its modified compounds are also employable for forming the protective film by application as well as the above-mentioned copolymer comprising fluoroolefin as a copolymer component, because they are soluble in a proper organic solvent of fluorine type such as a perfluoro-type solvent.

The protective film may contain a resin other than the fluoro-resin and may also contain additives such as a cross linking agent, a hardner and an anti-yellowing agent. However, in order to achieve the above-mentioned purpose, the amount of the fluoro-resin contained in the protective film is preferred to be not less than 30 wt. %, more preferably not less than 50 wt. %, and most preferably not less than 70 wt. %. Examples of the resin employable in combination with the fluoro-resin include polyurethane resin, polyacryl resin, cellulose derivatives, polymethyl methacrylate, polyester resin and epoxy resin.

The protective film of the radiographic intensifying screen of the invention may comprise one or both of an oligomer having polysiloxane structure and an oligomer having perfluoroalkyl group. The oligomer having polysiloxane structure has, for example, dimethylpolysiloxane structure, and it preferably has at least one functional group (e.g., hydroxyl group: —OH). Besides that, the molecular weight (average weight) preferably is within the range of 500–100,000, more preferably 1,000–100,000 and most preferably 3,000–100,000. The oligomer having perfluoroalkyl group (e.g., tetrafluoroethylene group) preferably has at least one functional group (e.g., hydroxyl group: —OH), and the molecular weight (average weight) of the oligomer preferably is within a range of 500–100,000, more preferably 1,000–100,000 and most preferably 10,000–100,000. The oligomer having a functional group is very advantageous because of the following reason: namely, such oligomer is fastened to the structure of the resin for forming the protective film by cross-linking reaction between the oligomer and the resin during formation of the protective film, and so the oligomer is hardly removed by iterative use of the screen or by cleaning the film surface, and consequently the oligomer can effectively work for a long time.

The amount of the oligomer contained in the film preferably is within the range of 0.01–10 wt. %, more preferably 0.1–2 wt. %.

The protective film also may contain a powder of perfluoroolefin resin or a powder of silicone resin. The average size of the powder of perfluoroolefin resin or silicone resin preferably is within the range of 0.1–10 μm, more preferably 0.3–5 μm. The amount of the powder of perfluoroolefin resin or the powder of silicone resin contained in the protective film preferably is within the range of 0.5–30 wt. %, more preferably 2–20 wt. % and most preferably 5–15 wt. %, based on the total weight of the protective film.

The radiographic intensifying screen of the invention preferably contains an electroconductive material (which serves as an antistatic agent) in at least one layer, namely, a support, a phosphor layer, a protective layer, or one or more of optionally provided auxiliary layer(s).

Examples of the electroconductive material capable of serving as an antistatic agent include oxides of Zn, Ti, Sn, In, Si, Mo, and W, complex metal oxides comprising two or more of these metal oxides, and these metal oxides doped with other atoms such as Al, In, Nb, Ta, Sn and/or halogen. The electroconductive material is solid and takes various forms such as granular (e.g., ball) and whisker (fibrous). Particularly preferred is a monocrystalline fiber (i.e., whisker) of $K_2O{\cdot}nTiO_2$ (n is an integer of 1 to 8) of which surface is treated with at least one of C, ZnO, $SnO_2$, $InO_2$, and a mixed crystal of $SnO_2$ and $InO_2$. This monocrystalline fiber is faborable because of its high antistatic property. Further, an electroconductive zinc oxide whisker in the form of a tetrapod or the like is particularly favorable, because it shows not only high antistatic property but also less deterioration of its coated film.

The electroconductive material can be incorporated into any of layers of the radiographic intensifying screen of the invention. For instance, the electroconductive material can be incorporated into the phosphor layer and the protective layer. In these cases, the electroconductive material is incorporated in an amount of 4/1 to 1/3, based on the binder forming these layers.

The electroconductive material can be incorporated into other layers which can be optionally provided in the radiographic intensifying screen. For instance, the electroconductive material can be placed, for instance, on the back of the support, between the support and the phosphor layer, and/or between the phosphor layer and the protective layer. In these cases, the electroconductive material can be incorporated in the form of an auxiliary layer comprising the electroconductive material and a binder in the ratio of 4/1 to 1/3. Such auxiliary layer can be provided by a coating method.

In the radiographic intensifying screen of the invention, it is preferred that the electroconductive material is mixed with a binder and the obtained mixture is coated on the support as an antistatic subbing layer to give an independent intervening layer between the support and the phosphor layer. In this case, the electroconductive material is preferably introduced into the intensifying screen in an amount capable of giving a surface resistivity of the subbing layer of $10^{12}$ ohm or less.

If desired, an organic antistatic agent such as a surface active agent can be into the radiographic intensifying screen alone or in combination with the above described electroconductive metal oxide type material.

The radiographic intensifying screen of invention preferably is highly sensitive and shows contrast transfer function (CTF) values of at least 0.79 and at least 0.36 at the spatial frequencies of 1 lp/mm and of 3 lp/mm, respectively.

Preferably, the radiographic intensifying screen of invention shows CTF values higher, at any spatial frequency, than the following relation curve between spatial frequency plotted on horizontal axis (lp/mm) and CTF values plotted on vertical axis.

| lp/mm | CTF |
|---|---|
| 0.00 | 1.00 |
| 0.25 | 0.950 |
| 0.50 | 0.905 |
| 0.75 | 0.840 |
| 1.00 | 0.790 |
| 1.25 | 0.720 |
| 1.50 | 0.655 |
| 1.75 | 0.595 |
| 2.00 | 0.535 |
| 2.50 | 0.430 |
| 3.00 | 0.360 |
| 3.50 | 0.300 |
| 4.00 | 0.255 |
| 5.00 | 0.180 |
| 6.00 | 0.130 |

The measurement and evaluation of the contrast transfer function of from a radiographic intensifying screen to a photographic material can be carried out using the MRE single face material specimen (available from Eastman Kodak) on which a rectangular chart is printed.

FIG. 1 shows the above relation curve between spatial frequency (lp/mm) and CTF values.

The preferred radiographic intensifying screen having the above-mentioned characteristics can be easily prepared by the method in which the above-described thermoplastic elastomer is used as a binder and the phosphor layer is compressed.

The detailed explanation with respect to the silver halide photographic material favorably employable in combination with the radiographic intensifying screen of the invention is given below.

The silver halide photographic material has the constitution: in which provided are silver halide photographic layers one of which is provided on the front of a support and another of which is on the back of the support; and at least one of said photosensitive layers has the sensitivity that 0.010–0.035 lux·second (preferably, 0.012–0.030 lux·second) of exposure dose is required to obtain an image having a density of 0.5 more than the minimum density thereon, said density being obtained by the steps of: exposing the photographic material to monochromatic light of which wavelength is the same as the main emission wavelength of the radiographic intensifying screen of the invention and of which half width is 15±5 nm, developing at 35° C. for 25 seconds in the developing solution (which is referred to as "Standard developer" or "Developer A", hereinafter) comprising the following:

| | |
|---|---|
| potassium hydroxide | 21 g |
| potassium sulfite | 63 g |
| boric acid | 10 g |
| hydroquinone | 25 g |
| triethylene glycol | 20 g |
| 5-nitroindazole | 0.2 g |
| glacial acetic acid | 10 g |
| 1-phenyl-3-pyrazolidone | 1.2 g |
| 5-methylbenztriazole | 0.05 g |
| glutaraldehyde | 5 g |
| potassium bromide | 4 g |

removing another photosensitive layer provided on the reverse side of the exposed face and then measuring the density of the remaining photosensitive layer.

Preferably, the silver halide photographic material is so produced that more than 15%, more preferably not more than 10%, most preferably 10 to 2%, of the light emitted by the intensifying screen placed on the front of said photographic material, that is, cross-over light, may not reach the photosensitive layer provided on the back of said material.

In the measurement of the sensitivity of the silver halide photographic material, the wavelength of exposing light should precisely or nearly correspond to the main emission wavelength of the radiographic intensifying screen used in combination. For instance, when terbium activated gadolinium oxysulfide phosphor is used as the phosphor of the intensifying screen, the wavelength of the light used for measuring the sensitivity of the photographic material should be around 545 nm because the main emission wavelength of the phosphor is 545 nm.

The monochromatic light can be obtained by means of a filter system in which interference filters are combined. Using such filters system, a monochromatic light which has sufficient intensity to be used and of which half width is 15±5 nm can be easily obtained, though the intensity of the light depends upon the combination of the interference filters. Since the spectral sensitivity spectrum of photographic material is continuous independently of spectral sensitization, the sensitivity is practically constant within the half width of 15±5 nm.

Figure 2:
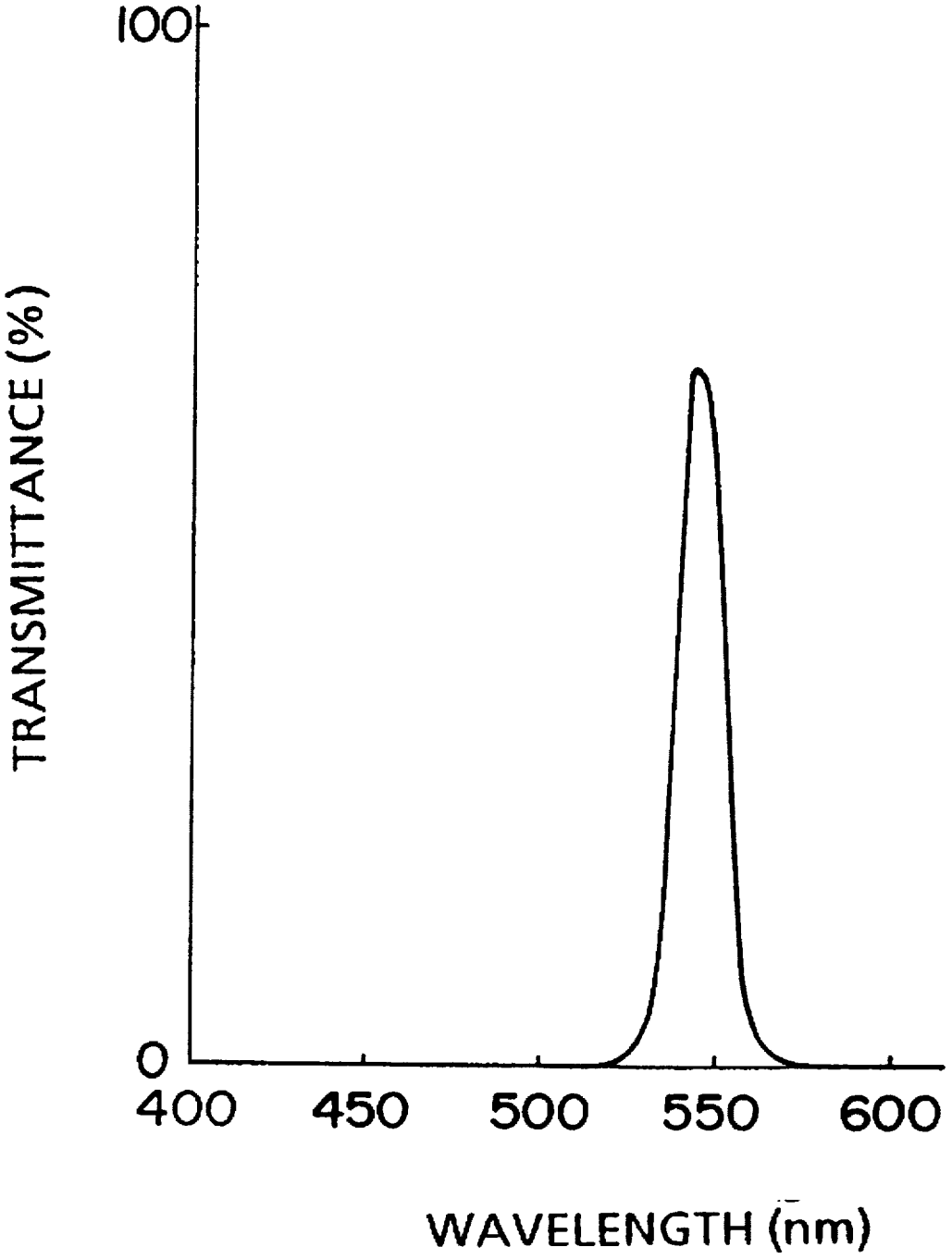
FIG. 2 shows the characteristic curve of the green filter used in combination with tungsten light source for measuring the sensitivity of a silver halide photographic material.

An example of the exposure light source, in the case that terbium activated gadolinium oxysulfide phosphor is used as the phosphor of the intensifying screen, is a system comprising a tungsten light (color temperature: 2,856K) and a filter having the characteristics shown in FIG. 2.

The following are standard conditions of a development process using the above-described Standard developer.

Developing time: 25 seconds (21 sec. in the solution+4 sec. in air)

Fixing time: 20 seconds (16 sec. in the solution+4 sec. in air; The fixing solution has the below-described composition.)

Washing: 12 seconds

Squeege and drying: 26 seconds

Developing Apparatus: a commercially available roller conveyor automatic developing machine (e.g., FPM-5000 automatic developing machine available from Fuji Photo Film Co., Ltd.); (Developing tank 22 liter [vol.], 35° C. [temp.]); (Fixing tank 15.5 liter [vol.], 25° C. [temp.]); Another example of the commercially available roller conveyor automatic developing machine is M-6AW available from Eastman Kodak.

The composition of the fixing solution (hereinafter, referred to as Fixing Solution F) is as follows:

| | |
|---|---|
| ammonium thiosulfate (70% wt./vol.) | 200 ml |
| sodium sulfite | 20 g |
| boric acid | 8 g |
| sodium ethylenediaminetetraacetate (dihydrates) | 0.1 g |
| aluminum sulfate | 15 g |
| sulfuric acid | 2 g |
| glacial acetic acid | 22 g |
| and water to adjust the volume to 1 liter, and then, if required, the value of pH is adjusted to 4.2 using sodium hydroxide or glacial acetic acid. | |

The measurement of the amount of the cross-over light (hereinafter simply referred to as "cross-over") is performed in the following manner: a photographic material having photosensitive layers provided on both sides is placed on the radiographic intensifying screen in contact with the front surface of the screen; and then a sheet of black paper is placed on the photographic material in contact with the front surface (i.e., the surface other than the surface contacting the screen) of said material; in this arrangement, the material is exposed to X-rays with various doses, which are adjusted by varying the distance between the intensifying screen and the focal spot of the X-ray generator; thereafter, the exposed material is developed and then divided into two sheets. From one sheet, the photosensitive layer having been in contact with the intensifying screen (back side photosensitive layer) is peeled off, and from another sheet, the photosensitive layer on the other side (front side photosensitive layer) is peeled off. Then, with respect to each of the remaining photosensitive layers, the optical density is measured and plotted against the corresponding dose to draw a characteristic curve for each layer. The average difference of the sensitivity (Δ log E) between the front and the back side layers is estimated from the straight line portion of each characteristic curve; and the amount of cross-over is calculated based on the estimated average difference of the sensitivity (Δ log E) in accordance with the following formula:

$$\text{Cross-Over (\%)}=100/(\text{antilog}(\Delta \log E)+1).$$

A typical silver halide photographic material comprises, for example, a subbing layer, a dye layer (which is provided to reduce the cross-over, if needed), at least one photosensitive silver halide emulsion layer, and a protective layer, superposed in this order on each side (i.e., on each of the front side and the back side) of a blue-colored transparent support. Preferably, each layer provided on one side is substantially the same as the corresponding layer provided on the other side.

The support is made of transparent material such as polyethylene terephthalate, and is colored with a blue dye. Various blue dyes such as anthraquinone dye, which is known as a dye for radiographic film, are employable. The thickness of the support is within the range of 160–200 μm.

A subbing layer of water-soluble polymer such as gelatin can be provided on the support in the same way as the conventional radiographic film.

If necessary, a dye layer is provided on the subbing layer to reduce cross-over. The dye layer is usually prepared in the form of a colloidal layer containing a dye, and the layer can be preferably decolorized in the developing process defined in the above. It is also preferred that the dye be fixed in the bottom part of the layer in order not to enter into the photosensitive silver halide emulsion layer or the protective layer provided thereon.

Various methods for decolorizing or fixing the dye in the colloidal layer described above are known. Examples of such methods include: method in which a combination of an anionic dye and a cationic mordant (European Patent Publication No. 211273B1) is used; method in which a combination of an anionic dye and a mordant of polymer dispersion prepared by adding unsaturated ethylene monomer having an anionic function group into a cationic mordant to be polymerized (Japanese Patent Provisional Publication No. (1990)-207242) is used; and method in which a solid fine crystalline dye (fine crystalline dye particles) is used (U.S. Pat. No. 4,803,150). Among the above methods, preferred is the method in which a solid fine crystalline dye (fine crystalline dye particles) is used.

The above-mentioned dye layer effectively reduces the cross-over to 15% or less, particularly 10% or less.

The following are examples of the anionic dyes used in the case that the dye layer is formed with a combination of an anionic dye and a cationic mordant:

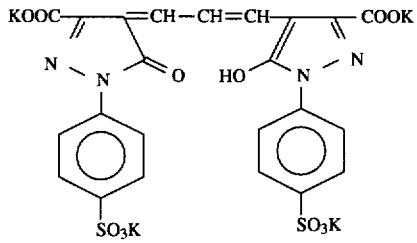

(a)

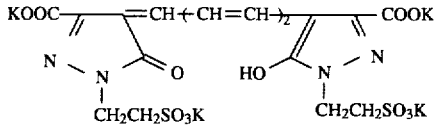

(b)

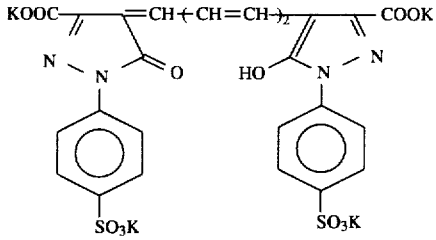

(c)

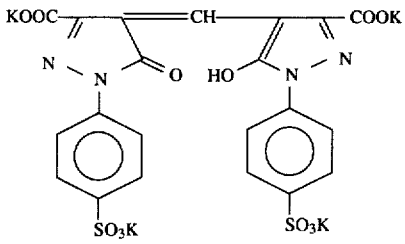

(d)

-continued
(e)
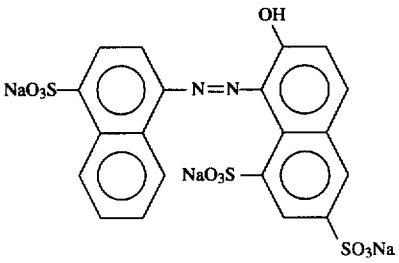
(f)
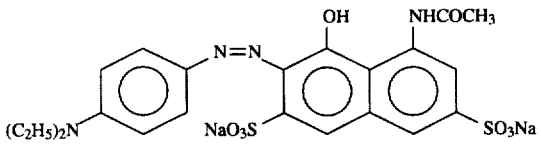
(g)
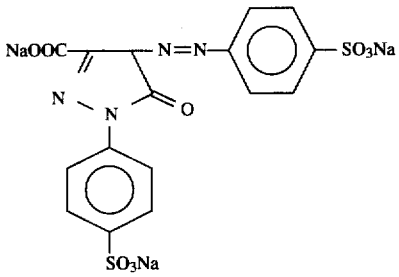
(h)
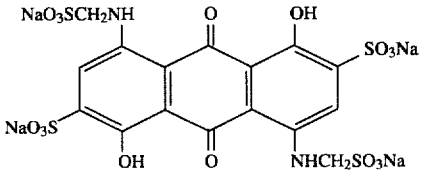
(i)
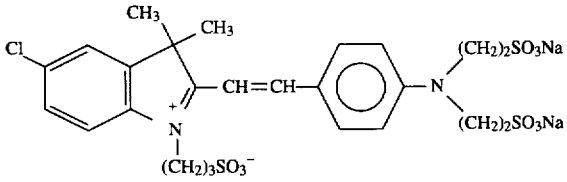
(j)
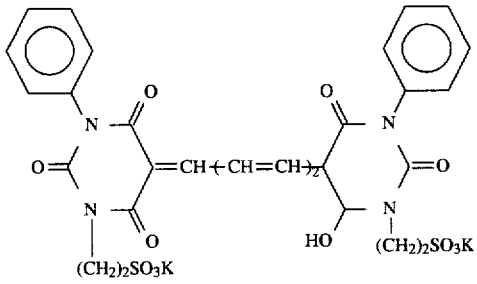
(k)
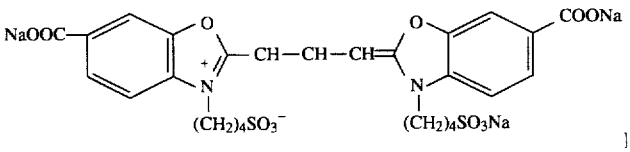

-continued
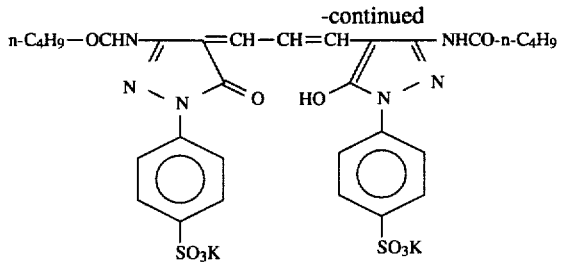
(l)
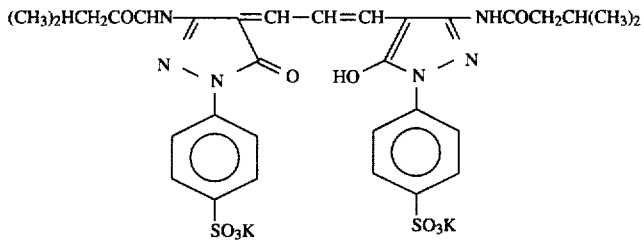
(m)
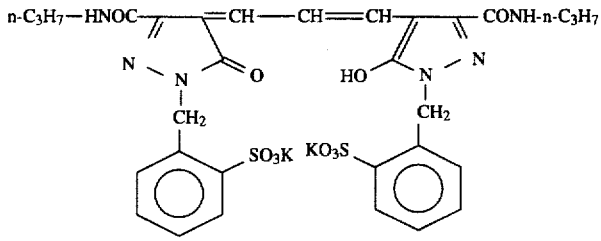
(n)
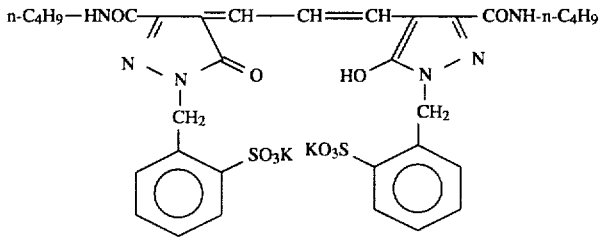
(o)
The following are examples of the solid fine crystalline dyes used in the case that the dye layer is formed of the solid fine crystalline dye.
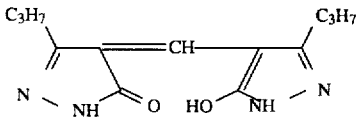
AH-1
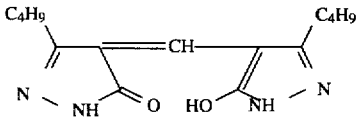
AH-2
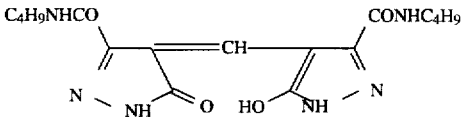
AH-3

-continued
AH-4
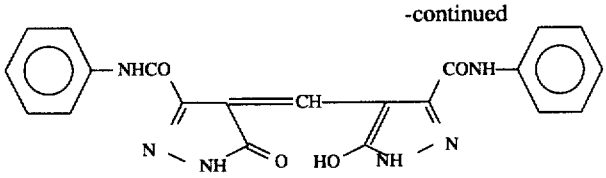
AH-5
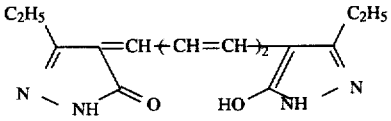
AH-6
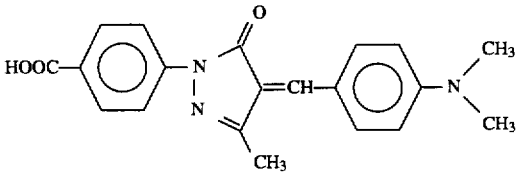
AH-7
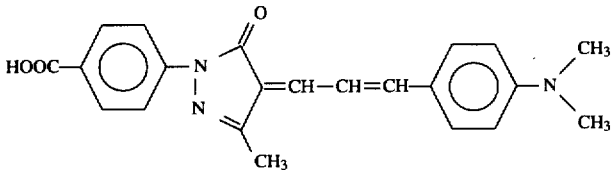
AH-8
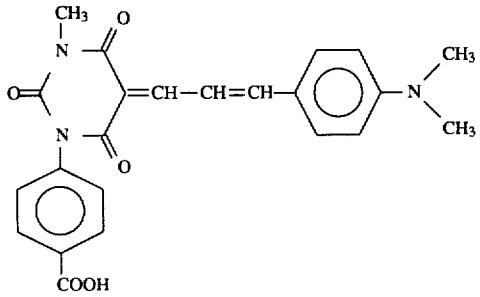
AH-9
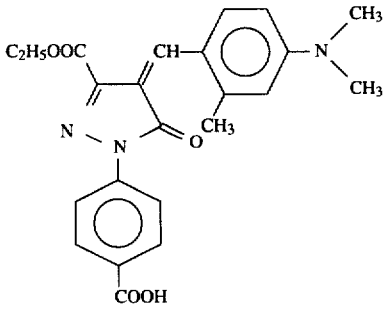
AH-10
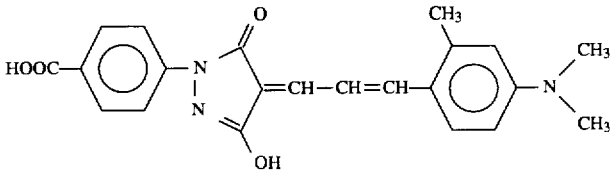
AH-11
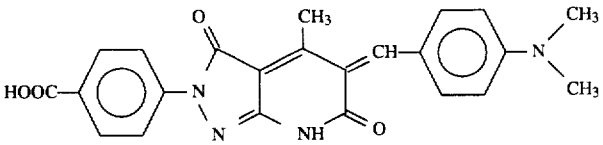

-continued
AH-12
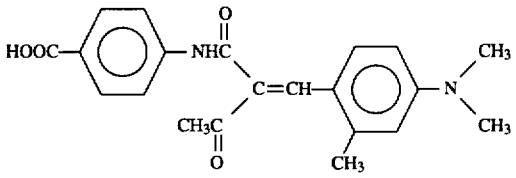
AH-13
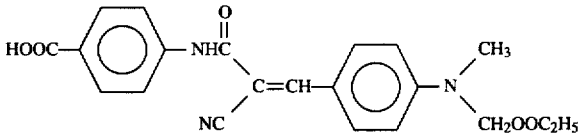
AH-14
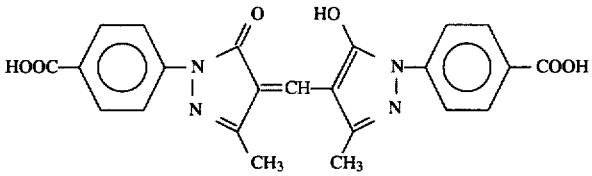
AH-15
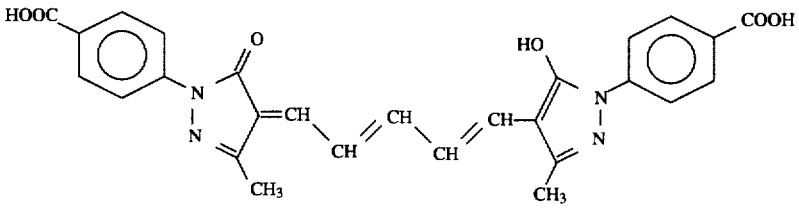
AH-16
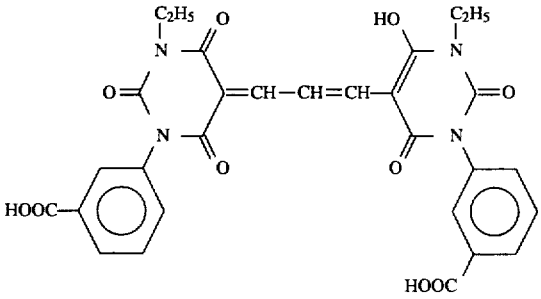
AH-17
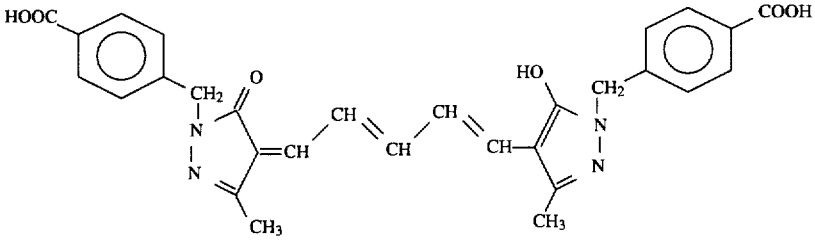
AH-18
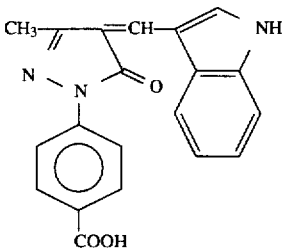

-continued

AH-19

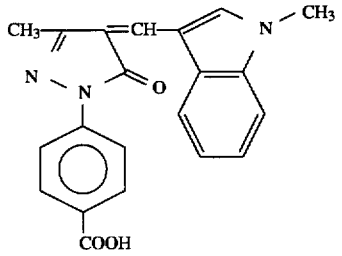

A photosensitive silver halide emulsion layer is provided on the dye layer. The photosensitive silver halide emulsion layer of the photographic material of the invention can be prepared in the known manner. However, since the silver halide emulsion used for the invention is relatively low-sensitive among the emulsions for known radiographic materials, it is preferred to comprise silver halide particles of a small size. The preferred size of the particles is 0.3–0.8 μm (more preferably, 0.5–0.7 μm) in terms of the mean diameter of the circle corresponding to the projected area, when a non-tabular particle (of which aspect ratio is nearly 1) is used for the invention. On the other hand, when the silver halide particles of tabular type (of which aspect ratio is 5/1–10/1) are used for the invention, the size of the particles preferably is within the range of 0.4–1.4 μm (more preferably, 0.5–1.0 μm).

The sensitivity of the silver halide emulsion can be reduced by other methods such as the method in which dyes are added to the emulsion, and the method in which the degree of sensitization (spectral sensitization or chemical sensitization) is reduced.

The silver halide photographic material should be sensitive to the light emitted by the radiographic intensifying screen used in combination. Since an ordinary silver halide emulsion is sensitive to the light of which wavelength is within the range of blue to ultraviolet, it can be used in combination with an intensifying screen which emits the luminescence of which wavelength is within the range of blue to ultraviolet (example of such screen is a radiographic intensifying screen using calcium tungstate phosphor). However, the silver halide in the photographic material should be spectral sensitized to green light if an intensifying screen using terbium activated gadolinium oxysulfide phosphor, which emits luminescence having main wavelength of 545 nm, is used.

Preferably, the silver halide emulsion for the silver halide photographic material comprises tabular silver halide particles. In fact, the emulsion comprising tabular silver halide particles exhibits excellent characteristics in balance between the sensitivity and the image quality, and has excellent spectral-sensitizable characteristics and high ability to reduce the cross-over. Therefore, such emulsion is very advantageous.

With respect to the process for preparing the tabular silver halide particle emulsion, various improved methods have been recently proposed. Such methods are employable for preparing the tabular silver halide particle emulsion for the preparation of the photographic material of the invention. Examples of such improved methods include: the method in which reduction sensitization is performed in combination with addition of a mercapto compound or a certain dye to improve the pressure characteristics; the sensitization method using selenium compounds; the method in which the iodide content of the particle surface is lowered to reduce the pressure mark possibly produced in the transfer using rollers; and the method (which is applied for preparing two silver halide emulsions used for the photographic material having double photosensitive layers) in which the silver/gelatin ratio of each emulsion is optimized to improve the balance between drying ability and reduction of the pressure mark produced in the transfer using rollers. These methods are disclosed in Japanese Patent Applications No. 3(1991)-145164, No. 3(1991)-228639, No. 2(1990)-89379, No. 2(1990)-288898, No. 2(1990)-225637, and No. 3(1991)-103639.

As is described above, the silver halide photographic material of the invention preferably has a dye layer which can be decolorized in the developing process performed under the aforementioned conditions. From this point of view, it is preferred to reduce the amount of the binder used in the photosensitive layer superposed on the dye layer. Actually, the amount of the binder in the photosensitive layer preferably is not more than 5 g/m$^2$, more preferably not more than 3 g/m$^2$. On the other hand, the amount of the silver contained in the photosensitive layer preferably is not more than 3 g/m$^2$, more preferably not more than 2 g/m$^2$.

The silver halide photographic material is preferably prepared to give an exposure image having the following characteristic curve, after stepwise exposing the photographic material to X-rays and developing the material under the conditions described above: the characteristic curve having the mean gamma (γ) between the point of the density higher than the minimum density by 0.1 (the point of $D_{min}$+ 0.1) and the point of the the density higher than the minimum density by 0.5 (the point of $D_{min}$+0.5) within the range of 0.5–0.9, and the mean gamma (γ) between the point of $D_{min}$+1.2 and the point of $D_{min}$+1.6 within the range of 3.2–4.0; said characteristic curve being drawn on the rectangular coordinate in which the unit length of the axis of optical density (D) is the same as that of the axis of exposure (log E).

If the silver halide photographic material giving the above-described characteristic curve is employed for the radiographic system, a radiographic image having excellent characteristics can be obtained. In more detail, the characteristic curve of such image shows an elongated toe and high gamma in the medium density region. Therefore, by the use of the photographic material having the above-described characteristics, radiographic images of a low density (such as a radiographic image of mediastinum or shadow of heart, through which only a small amount of X-rays can pass) can be made much clearer and the density of a radiographic image of the field of lung through which a large amount of X-rays can pass, can be more clearly visualized. Besides that, the contrast of the images are also improved.

The silver halide photographic material giving the above-described preferable characteristic curve can be a photographic material having two or more silver halide emulsion layers, provided on each side of which sensitivities differ from each other. With respect to such photographic material, it is particularly preferred that the upper layer be of high sensitive and the lower one be of low sensitivity and give high contrast. When the photographic material has two emulsion layers on each side, the difference of sensitivity between the two layers generally is set to not less than 1.5 times, preferably not less than twice, as much as the sensitivity of the lower layer. The ratio of the amounts of the emulsions used in each layer is determined according to the differences of sensitivity and covering power between the adopted emulsions. Generally, the amount of the high sensitive emulsion to be used is reduced, when the difference of sensitivity is increased. For instance, if one emulsion is twice as sensitive as the other and that covering powers of them are nearly the same, the ratio of the high sensitive emulsion to the low-sensitive one is within the range of 1:20 to 1:5, in terms of the amount of silver.

On the above-described composite comprising a subbing layer and photosensitive layers provided on each side of the support in the above-described manner, a protective layer comprising a water-soluble polymer such as gelatin is provided in the known manner to finally prepare a silver halide photographic material.

With respect to methods for sensitizing the emulsion, various additives, constituting materials and processes for developing, there are no particular restrictions in the invention. The following is a detailed explanation of the combination of the invention.

The preferred combination can be constituted by a combination of a photographic material having the specific sensitivity and one or two high sensitive radiographic intensifying screens which absorb X-rays to give spatial frequencies in the specific range. However, a preferred example of the combination comprises a radiographic intensifying screen which absorbs X-rays of 80 $KV_p$ in the ratio of 30 to 40% and a photographic material whose sensitivity defined hereinbefore corresponds to 0.012–0.015 lux·second. A further preferred example of the combination comprises a pair of a radiographic intensifying screen which absorbs X-rays of 80 $KV_p$ in the ratio of 30 to 40% and a photographic material of which sensitivity defined above corresponds to 0.02–0.03 lux·second. The latter can give an image having excellent image quality with a practical sensitivity (i.e., an acceptable dose of X-rays).

Preferably used for the combination is a silver halide photographic material in which each of the front and the back photosensitive layers satisfies the above-described conditions concerning the sensitivity, and the characteristics of corresponding layers are substantially the same. On each side of such photographic material, a radiographic intensifying screen having the same characteristics as those of the intensifying screen on the other side is preferably provided. However, in order to improve the balance between image sharpness and sensitivity, the amount of the phosphor coated on the front intensifying screen can be made to be smaller than that of the phosphor coated on the back side screen, as is described in U.S. Pat. No. 4,710,637.

Preferably, the combination of the invention comprising a silver halide photographic material and two radiographic intensifying screens is selected so that the combination can have practically acceptable sensitivity and further that excellent radiographic image quality can be obtained. Actually, it is preferred that the total sensitivity of the combination gives the density of 1.0, the density being obtained by the steps of exposing the combination to X-rays of 80 $KV_p$ with a exposure dose in the range of 0.5–1.5 mR generated by a three-phase X-ray generator and developing in the above-defined developing solution under the aforementioned conditions.

The following is the explanation of the measurement and the principle concerning the measurement to evaluate the performance of a combination of a radiographic intensifying screen and a silver halide photographic material.

The measurement of Detective Quantum Efficiency (DQE) is generally utilized for measuring image formation efficiency of a combination comprising a silver halide photographic material and radiographic intensifying screens. Further, the measurement of Noise Equivalent Quanta (NEQ) is also used for totally evaluating both sharpness and graininess. The value of DQE is calculated by dividing $(\text{Signal/Noise})^2$ value of the image finally formed on the photographic material of the combination by $(\text{Signal/Noise})^2$ value of the X-rays impinged onto the photographic material. If an ideal image is formed, the value of DQE is 1. However, the value is usually less than 1. On the other hand, the value of NEQ is defined by $(\text{Signal/Noise})^2$ value of the finally obtained image. The relation between DQE and NEQ is represented by the following formulas:

$$DQE(v)=NEQ(v)/\underline{Q}$$

$$NEQ(v)=\{\log e\times\gamma(MTF(v))\}^2/NPS_0(v)$$

wherein y represents the contrast, MTF(v) is the modulation transfer function of the image, $NPS_0(v)$ is the output noise power spectrum, v represents spatial frequency, and $\underline{Q}$ is the number of the impinged X-ray quanta.

The relation between sensitivity and image quality can be evaluated by DQE. A combination of high DQE exhibits excellent balance between sensitivity and image quality. On the other hand, the image quality of the finally obtained image can be evaluated by NEQ. In other words, if the combination has a higher NEQ, it gives better image quality. However, since NEQ gives physical evaluation of the image quality, it does not directly indicate clinical recognizability of the image. In fact, if the graininess and the sharpness of the image are extremely unbalanced, the image does not exhibit high visual recognizability for diagnosis. Therefore, from a clinical point of view, the image is preferably evaluated based on both NEQ and MTF.

EXAMPLE 1

Preparation of Radiographic Intensifying Screen A 200 g of a phosphor ($Gd_2O_2S$:Tb), 20 g of Binder A (polyurethane, Desmolac TPKL-5-2625 (tradename); available from Sumitomo Bayer Urethane Co., Ltd. [solid content: 40%]), and 2 g of Binder B (nitrocellulose, nitration degree: 11.5%) were added to methyl ethyl ketone. The resulting mixture was stirred by a propeller agitator to prepare a coating dispersion (for forming a phosphor sheet) having a viscosity of 30 PS (at 25° C.) [binder/phosphor= 1/20].

The obtained dispersion was coated on a polyethylene terephthalate film (false support, thickness: 180 μm) which had been beforehand coated with a silicon release agent so that the thickness of the obtained phosphor layer would be 160 μm (this thickness was measured after the compression treatment described below was done). After being dried, the coated film was peeled off to give a phosphor sheet.

Further, 90 g of soft acryl resin and 50 g of nitrocellulose were added to methyl ethyl ketone. The resulting mixture was stirred to prepare a coating dispersion for a subbing layer having a viscosity of 3–6 PS (at 25° C.).

The obtained dispersion for a subbing layer was coated by a doctor blade on a polyethylene terephthalate film containing titanium dioxide (support, thickness: 250 μm) which was placed on a glass plate. The coated layers were heated at temperatures gradually rising from 25° C. to 100° C. to prepare a subbing layer (thickness: 15 μm). The phosphor sheet prepared above was superposed on the subbing layer, and then the prepared composite was compressed at a pressure of 400 kgw/cm$^2$ and a temperature of 80° C. using a calender roll.

Independently, 70 g of fluoro-resin (fluoroolefin-vinyl ether co-polymer, Lumiflon LF100 (tradename); available from Asahi Glass Co., Ltd.), 25 g of a cross-linking agent (isocyanate, Desmodul Z4370 (tradename); available from Sumitomo Bayer Urethane Co., Ltd.), 5 g of an epoxy resin of Bisphenol A type and 5 g of an alcohol modified silicone oligomer (which had dimethylpolysiloxane structure and hydroxyl groups (carbinol groups) at both terminals, X-22-2809 (tradename); available from Shin-Etsu Chemical Co., Ltd.) were added to methyl ethyl ketone to prepare a dispersion for a protective film.

The obtained dispersion for a protective film was coated by a doctor blade on the phosphor layer having been compressed on the support. The coated film was heated to 120° C. for 30 minutes to prepare a transparent protective film having a thickness of 3 μm.

Thus, the radiographic intensifying screen A consisting of a support, a subbing layer, a phosphor layer and a transparent protective film of 3 μm thick was prepared.

EXAMPLE 2

Preparation of Radiographic Intensifying Screen B

The procedure of Example 1 was repeated except that the phosphor layer was prepared so that the thickness of the obtained layer would be 230 μm (this thickness was measured after the compression treatment was made) to prepare the radiographic intensifying screen B consisting of a support, a subbing layer, a phosphor layer and a transparent protective film of 3 μm thick.

EXAMPLE 3

Preparation of Radiographic Intensifying Screen C

The procedure of Example 1 was repeated except that the coating dispersion for preparation of the protective layer was replaced with the following coating dispersion, to prepare the radiographic intensifying screen C consisting of a support, a subbing layer, a phosphor layer and a transparent protective film of 3 μm thick.

(Preparation of coating dispersion)

70 g of fluoro-resin (fluoroolefin-vinyl ether copolymer, Lumiflon LF100), 25 g of a cross-linking agent (isocyanate, Desmodul Z4370), and 5 g of an epoxy resin of Bisphenol A type were added to a mixture of toluene and isopropyl alcohol (1:1, volume ratio) to prepare a dispersion for a protective film.

EXAMPLE 4

Preparation of Radiographic Intensifying Screen D

The procedure of Example 1 was repeated except that the coating dispersion for preparation of the protective layer was replaced with the following coating dispersion, to prepare the radiographic intensifying screen D consisting of a support, a subbing layer, a phosphor layer and a transparent protective film of 3 μm thick.

(Preparation of coating dispersion)

70 g of fluoro-resin (fluoroolefin-vinyl ether copolymer, Lumiflon LF100), 25 g of a cross-linking agent (isocyanate, Desmodul Z4370), 5 g of an epoxy resin of Bisphenol A type and a powdery silicone resin (KMP-590, tradename, available from Shin-Etsu Chemical Co., Ltd.) were added to a mixture of toluene and isopropyl alcohol (1:1, volume ratio) to prepare a dispersion for a protective film.

COMPARISON EXAMPLE 1

Preparation of Radiographic intensifying screen E

The procedure of Example 1 was repeated except that the protective layer was prepared so that the thickness of the obtained layer would be 10 μm to prepare the radiographic intensifying screen E consisting of a support, a subbing layer, a phosphor layer and a transparent protective film of 10 μm thick.

COMPARISON EXAMPLE 2

Preparation of Radiographic intensifying screen F

The procedure of Example 3 was repeated except that the protective layer was prepared so that the thickness of the obtained layer would be 10 μm to prepare the radiographic intensifying screen F consisting of a support, a subbing layer, a phosphor layer and a transparent protective film of 10 μm thick.

COMPARISON EXAMPLE 3

Preparation of Radiographic intensifying screen G

The procedure of Example 4 was repeated except that the protective layer was prepared so that the thickness of the obtained layer would be 10 μm to prepare the radiographic intensifying screen G consisting of a support, a subbing layer, a phosphor layer and a transparent protective film of 10 μm thick.

COMPARISON EXAMPLE 4

Preparation of Radiographic intensifying screen H

The procedure of Example 1 was repeated except that the coating dispersion for preparation of the protective layer was replaced with the following coating dispersion, to prepare the radiographic intensifying screen H consisting of a support, a subbing layer, a phosphor layer and a transparent protective film of 3 μm thick.

(Preparation of coating dispersion)

70 g of polyurethane resin (Desmolac 4125, tradename, available from Sumitomo Bayer Urethane Co., Ltd.), 25 g of a cross-linking agent (isocyanate, Desmodul Z4370), and 5 of an epoxy resin of Bisphenol A type were added to a mixture of toluene and isopropyl alcohol (1:1, volume ratio) to prepare a dispersion for a protective film.

COMPARISON EXAMPLE 5

Preparation of Radiographic intensifying screen I

The procedure of Comparison Example 4 was repeated except that the protective layer was prepared so that the thickness of the obtained layer would be 10 μm to prepare the radiographic intensifying screen I consisting of a support, a subbing layer, a phosphor layer and a transparent protective film of 10 μm thick.

(1) Evaluation of resistance to stain

A small piece of a radiographic film was placed on the protective layer of a sample radiographic intensifying screen and kept at 60° C., 80% RH for 24 hours. The surface of the protective layer was wiped using isopropyl alcohol and then the surface of the protective layer was visually observed. Thus treated sample radiographic screen was subjected to the procedure for obtaining a radiographic image, and the obtained radiographic image was observed visually. By these procedures, the resistance to stain was evaluated. In the evaluation, the following ranking was given:

A: no stain was observed on the protective layer, and no stain was observed on the radiographic image;

B: some stain was observed on the protective layer (at the site where the piece of the film had been placed), but no stain was observed on the radiographic image;

C: some stain was observed on the protective layer (at the site where the piece of the film had been placed), and certain stain was observed on the radiographic image.

(2) Measurement of contrast transfer function (CTF)

A photographic material (MRE single face type; available from Eastman Kodak) was placed in close contact with the sample screen, and then a radiographic image of a rectangular chart for measuring MTF (made of molybdenum, thickness: 80 μm, spatial frequency: 0–10 lp/mm) was obtained in the following manner.

The chart was placed in front of an X-ray tube at a distance of 2 m. The photographic material was placed behind the chart (i.e., material faced the tube through the chart) and the sample intensifying screen was provided behind the photographic material in close contact.

The X-ray tube was DRX-3724HD (Trade name) available from Toshiba Corporation, in which X-rays were generated by tungsten target and a pulse generator (80 $KV_p$, three-phase), and then passed through 3 mm thick aluminium equivalent material including aperture to make the focal spot size of 0.6 mm×0.6 mm. The X-rays generated from the tube were made to pass through a filter of water having a path of 7 cm (which absorbed X-rays in nearly the same amount as a human body) to obtain a radiographic image of the chart.

The exposed photographic material was developed by means of a roller conveyor automatic developing machine (FPM-5000) available from Fuji Photo Film Co., Ltd. in the manner described hereinbefore. In the development process, RD III developing solution available from Fuji Photo Film Co., Ltd. (of which composition was the same as that of above-described Developing Solution A) was used at 35° C., and Fixing Solution F (which was prepared in the following manner: 200 ml of ammonium thiosulfate [70% wt./vol.], 20 g of sodium sulfite, 8 g of boric acid, 0.1 g of disodium ethylenediaminetetraacetate [dihydrates], 15 g of aluminum sulfate, 2 g of sulfuric acid, and 22 g of glacial acetic acid were added to water so that the volume would be 1 liter, and then the value of pH was adjusted to 4.2) was used at 25° C. Thus, the sample for the measurement was prepared. The dose of X-rays in the exposure process described hereinbefore was determined so that the average difference between the highest and the lowest density of the developed image would be 1.

The density of the radiographic image of the developed sample was measured to obtain a density profile by means of a microdensitometer under the condition that the aperture was a slit of 30 μm×500 μm (scanning direction×vertical direction) and the sampling distance was 30 μm. This procedure was repeated twenty times and the obtained values were averaged to obtain the density profile on which CTF was calculated. Thereafter, the peak corresponding to the pulse of each spatial frequency in the density profile was observed to calculate the density contrast of each frequency.

The obtained values concerning spatial frequencies of 2 lp/mm are set forth in Table 1.

TABLE 1

| | Radiographic intensifying screen | Resistance to stain | CTF (2 lp/mm) |
|---|---|---|---|
| Example 1 | Intensifying screen A | A | 66.2% |
| Example 3 | Intensifying screen C | B | 66.0% |

TABLE 1-continued

| | Radiographic intensifying screen | Resistance to stain | CTF (2 lp/mm) |
|---|---|---|---|
| Example 4 | Intensifying screen D | B | 66.5% |
| Com. Ex. 1 | Intensifying screen E | A | 54.5% |
| Com. Ex. 2 | Intensifying screen F | A | 54.5% |
| Com. Ex. 3 | Intensifying screen G | A | 54.5% |
| Com. Ex. 4 | Intensifying screen H | C | 66.5% |
| Com. Ex. 5 | Intensifying screen I | C | 55.0% |

From the data given in Table 1, it is apparent that the radiographic intensifying screens of the invention having thereon a coated protective layer of fluro-resin in a thickness of less than 5 μm show a high CTF value and give a radiographic image without stains caused by the radiographic film having been placed thereon. Accordingly, the radiographic intensifying screen of the invention is very advantageously employed.

EXAMPLE 5

(1) Each of the following radiographic intensifying screens was prepared in a pair (i.e., front screen and back screen).

HR-3 (commercially available from Fuji Photo Film Co., Ltd.)

HR-4 (commercially available from Fuji Photo Film Co., Ltd.)

HR-8 (commercially available from Fuji Photo Film Co., Ltd.)

Radiographic intensifying screen A (Sample A)

Radiographic intensifying screen B (Sample B)

(2) Evaluation of characteristics of radiographic intensifying screens

1) Measurement of X-ray absorption

An X-ray generator of tungsten target tube (80 $KV_p$, three-phase) was set, and the sample screen was placed in front of the tungsten anode of the target tube at a distance of 200 cm. Thereafter, the sample screen was exposed to X-rays generated by the tube through an aluminium plate having the thickness of 3 mm. The amount of X-rays passing through the screen was measured by an ionization dosimeter placed behind the screen at a distance of 50 cm. Independently, as a blank test, the measurement without the screen was carried out to obtain the amount of X-rays directly reaching the dosimeter.

The obtained values are set forth in Table 2.

2) Measurement of contrast transfer function (CTF)

The CTF was measured in the aforementioned manner.

The obtained values concerning spatial frequencies of 1 line/mm and 3 lines/mm are set forth in Table 2.

3) Measurement of sensitivity

A green-sensitized photographic material (MRE single face type; available from Eastman Kodak) was combined with the sample intensifying screen to give a combination, and then the combination was stepwise exposed to X-rays varying the dose by the step width of log E=0.15. In this exposure process, the dose was adjusted by varying the distance between the combination and the X-ray source, which was the same generator as used in the above-described CTF measurement. The exposed material was developed in the same manner as described in the CTF measurement. Thus, the sample for the measurement was prepared.

The density of the prepared sample was measured using visible light to obtain a characteristic curve. According to the obtained characteristic curve, the dose of X-rays required to give a density of $D_{min}$+1.0 was measured and the sensitivity was defined by the reciprocal number of said required dose. The calculated sensitivity of each sample was reduced to a relative value, based on the sensitivity of HR-4 (commercially available radiographic intensifying screen) on the back side being set at the value of 100 as the standard. The results are set forth in Table 2.

TABLE 2

| screen | X-ray absorption | Sensitivity | CTF (1 lp/mm) | CTF (3 lp/mm) |
|---|---|---|---|---|
| HR-3 (front) | 18.2% | 48 | 0.890 | 0.660 |
| HR-3 (back) | 18.2% | 48 | 0.889 | 0.660 |
| HR-4 (front) | 22.3% | 89 | 0.850 | 0.510 |
| HR-4 (back) | 23.1% | 100 | 0.850 | 0.506 |
| HR-8 (front) | 31.3% | 155 | 0.775 | 0.340 |
| HR-8 (back) | 32.2% | 170 | 0.763 | 0.336 |
| Screen A | 32.8% | 200 | 0.869 | 0.494 |
| Screen B | 43.2% | 270 | 0.802 | 0.375 |

(3) Each of the following silver halide photographic materials was prepared.

Super HRS (commercially available from Fuji Photo Film Co., Ltd.)

Silver halide photographic material I (Sample I)

Silver halide photographic material II (Sample II)

Silver halide photographic material III (Sample III)

Silver halide photographic material IV (Sample IV)

1) Preparation of silver halide photographic material I (Preparation of fine tabular particle-monodispersed emulsion)

6.0 g of potassium bromide and 8.0 g of gelatin were added to 1 liter of water, and the prepared mixture was stirred and kept at 55° C. At this temperature, 37 cc of aqueous silver nitrate solution (containing 4.0 g of silver nitrate) and 38 cc of an aqueous solution of 5.7 g of potassium bromide were added to the mixture by the double-jet method for 37 seconds. After 18.6 g of gelatin was further added to the obtained solution, the solution was heated to 70° C., and then 89 cc of aqueous silver nitrate solution (containing 9.8 g of silver nitrate) was added for 22 minutes. To the resulting solution, 7 cc of 25% aqueous ammonia was added. Then, the solution was settled for 10 minutes, keeping the temperature for physical-ripening. Subsequently, 6.5 cc of 100% acetic acid was added. To the obtained solution, an aqueous solution of 153 g of silver nitrate and an aqueous potassium bromide solution were added by the controlled double-jet method for 35 minutes while the pAg value of the solution was kept at 8.5. To the obtained emulsion, 15 cc of 2N potassium thiocyanate was added. Then, the prepared emulsion was settled for 5 minutes keeping the temperature for physical-ripening. The emulsion was cooled to 35° C.

Thus, a silver halide emulsion (tabular silver bromide particle-monodispersed emulsion, thickness: 0.165 μm, variation coefficient: 18.5%, mean diameter of the circle corresponding to the projected area: 1.10 μm) was obtained.

From the prepared emulsion, salts were removed by the precipitation method. After the emulsion was heated to 40° C., 30 g of gelatin, 2.35 g of phenoxyethanol and 0.8 g of sodium polystyrenesulfonate as a viscosity improver were added. The pH and pAg values of the resulting emulsion were adjusted to 5.90 and 8.25, respectively, with sodium hydroxide and aqueous silver nitrate solution.

After the above-described procedure was complete, the emulsion was chemically sensitized under stirring at 56° C. in the following manner.

Silver bromide was added to the emulsion at a ratio of 0.1 mol %, and then 0.043 mg of thiourea dioxide was added. Subsequently, the emulsion was settled for 22 minutes for performing reduction sensitization. To the sensitized emulsion, 20 mg of 4-hydroxy-6-methyl-1,3,3a,7-tetraazaindene and 400 mg of the following sensitizing dye were added:

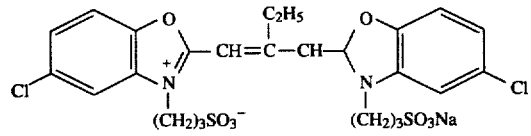

To the resulting emulsion, 0.83 g of calcium chloride was further added. Subsequently, 1.3 mg of sodium thiosulfate, 2.7 mg of the following selenium sensitizer:

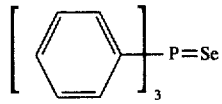

2.6 mg of chloroauric acid and 90 mg of potassium thiocyanate were added. The emulsion was settled for 40 minutes and then cooled to 35° C. Thus, a fine tabular particle-monodispersed emulsion was obtained.

(Preparation of coating dispersion)

a) coating dispersion for silver halide emulsion layer

To the above-prepared fine tabular particle-monodispersed emulsion, the following components were added in the amounts described below per 1 mol of silver halide to prepare a coating dispersion for the emulsion layer.

| | |
|---|---|
| gelatin | 65.5 g |
| trimethylpropane | 9.0 g |
| dextran (mean m.w.: 39,00) | 18.5 g |
| sodium poly(styrenesulfonate) (mean m.w.: 600,000) | 1.8 g |
| 1,2-bis(vinylsulfonylacetamide)ethane [hardening agent]: 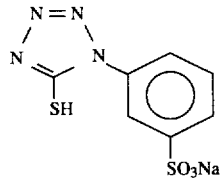 | 34 mg |
| 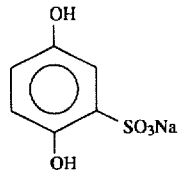 | 4.8 g |

The hardening agent was added in such amount that the swelling ratio would be 230%.

b) coating dispersion for surface protective layer

A coating dispersion containing the following components per 1 $m^2$ was prepared:

| | |
|---|---|
| gelatin | 0.966 g |
| sodium polyacrylate (mean m.w.: 400,000) | 0.023 g |
| 4-hydroxy-6-methyl-1,3,3a,7-tetraazaindene | 0.015 g |
| poly(methyl methacrylate) (mean grain size: 3.7 μm) | 0.087 g |
| proxcell | 0.0005 g |

(The pH value was adjusted to 7.4 with NaOH.)

-continued

| | |
|---|---|
| 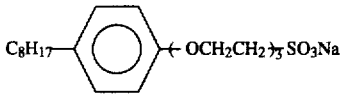 | 0.013 g/m² |
| $C_{16}H_{33}O(CH_2CH_2O)_{10}H$ | 0.045 g |
| $C_{17}H_{33}CON(CH_3)CH_2CH_2SO_3Na$ | 0.0065 g |
| $C_8H_{17}SO_2N(C_3H_7)(CH_2CH_2O)_{15}H$ | 0.003 g |
| $C_8H_{17}SO_2N(Chd\ 3H_7)(CH_2CH_2O)_4(CH_2)_4HSO_3Na$ | 0.001 g |
| 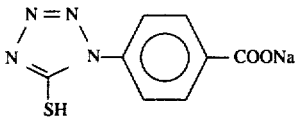 | 1.7 mg/m² |
| 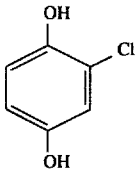 | 100 mg/m² |

(Support)

The surface of a biaxially stretched polyethylene terephthalate film colored with a blue dye having a thickness of 175 μm was subjected to corona discharge treatment. Then, each surface was sequentially and superposingly coated with the coating dispersions having the following composition in the amounts described below (amount of each component was based on a dispersion for coating a single face) by a wire-bar coater to form a subbing layer consisting of two sub-layers on each surface.

| | |
|---|---|
| a) lower sub-layer of subbing layer | |
| butadiene.styrene co-polymer latex (butadiene/styrene = 31/69 by weight) | 0.322 g/m² |
| 2,4-dichloro-6-hydroxy-s-triazine.sodium salt | 8.4 mg/m² |
| $n\text{-}C_6H_{13}OCOCH_2$ \| $n\text{-}C_6H_{13}OCOCH-SO_3Na$ | 1.29 mg/m² |
| 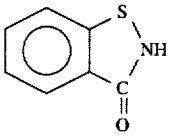 | 0.27 mg/m² |
| b) upper sub-layer of subbing layer | |
| gelatin | 300 mg/m² |
| polyethylene terephthalate | 20 mg/m² |
| $C_{12}H_{25}O(CH_2CH_2O)_{10}H$ | 4 mg/m² |
| 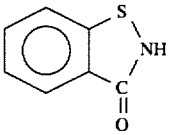 | 0.3 mg/m² |
| poly(methyl methacrylate) particles (mean grain size: 2.5 μm) | 2.5 mg/m² |

(Photographic material)

The above-described coating dispersions for silver halide emulsion layer and for surface protective layer were simultaneously and superposingly applied on the support having subbing layers each of which had been provided on each surface. Thus, Silver halide photographic material I, which had a silver halide emulsion layer and a surface protective layer both of which were provided on each side, was obtained. The amount of the applied coating dispersion of silver halide emulsion was 1.8 g/m² (amount in terms of silver metal) per one surface.

2) Preparation of Silver halide photographic material II

The procedure of the preparation of Silver halide photographic material I was repeated except that the amount of gelatin initially used was changed to 6 g to prepare a silver halide emulsion (tabular silver bromide particle-monodispersed emulsion, thickness: 0.160 μm, variation coefficient: 17.5%, mean diameter of the circle corresponding to the projected area: 1.00 μm).

The obtained emulsion was sensitized to prepare a coating dispersion in the same manner as described in the procedure for Silver halide photographic material I. From the obtained dispersion, Silver halide photographic material II was prepared in the same manner as described in the procedure for Silver halide photographic material I. The amount of the applied coating dispersion of silver halide emulsion was 1.64 g/m² (amount in terms of silver metal) per one surface.

3) Preparation of Silver halide photographic material III

The procedure of the preparation of Silver halide photographic material I was repeated except that the amount of gelatin initially used was changed to 6 g and that the temperature was changed to 50° C. to prepare a silver halide emulsion (tabular silver bromide particle-monodispersed emulsion, thickness: 0.155 μm, variation coefficient: 19.0%, mean diameter of the circle corresponding to the projected area: 0.85 μm).

The obtained emulsion was sensitized to prepare a coating dispersion in the same manner as described in the procedure for Silver halide photographic material I. From the obtained dispersion, Silver halide photographic material III was prepared in the same manner as described in the procedure for Silver halide photographic material I. The amount of the applied coating dispersion of silver halide emulsion was 1.50 g/m² (amount in terms of silver metal) per one surface.

4) Preparation of Silver halide photographic material IV

The procedure of the preparation of Silver halide photographic material I was repeated except that the amount of gelatin initially used was changed to 5 g and that the temperature was changed to 40° C. to prepare a silver halide emulsion (tabular silver bromide particle-monodispersed emulsion, thickness: 0.155 μm, variation coefficient: 18.0%, mean diameter of the circle corresponding to the projected area: 0.65 μm).

The obtained emulsion was sensitized to prepare a coating dispersion in the same manner as described in the procedure for Silver halide photographic material I. From the obtained dispersion, Silver halide photographic material IV was prepared in the same manner as described in the procedure for Silver halide photographic material I. The amount of silver halide emulsion of the applied coating dispersion was 1.38 g/m² (amount in terms of silver metal) per one surface.

(4) Evaluation of characteristics of the silver halide photographic material

1) Measurement of sensitivity

The sensitivity of the sample material was measured using light emitted by a tungsten light source (color temperature: 2856K) and then passing through the optical filter having the characteristic curve shown in FIG. 2 (by which the wavelength of the light was set to around 545 nm— corresponding to the main wavelength of the luminescence of the below-described radiographic intensifying screen used in combination). The sample photographic material was exposed to the above light through a neutral step wedge for 1/20 second.

The exposed photographic material was developed in RD III developing solution available from Fuji Photo Film Co., Ltd. (of which composition was the same as those of the above-described developing solution A) at 35° C. for 25 seconds (total processing time: 90 seconds) by means of an automatic developing machine (FPM-5000) available from Fuji Photo Film Co., Ltd. The photosensitive layer provided on the reverse side of the exposed face was removed, and the density was measured on the remaining photosensitive layer to obtain the characteristic curve.

According to the obtained characteristic curve, the exposure dose required to give the density of $D_{min}$+0.5 was calculated and the sensitivity was defined by the required exposure dose. The results expressed by lux·second are set forth in Table 3. In order to calculate the exposure dose, the illuminance of the light emitted by the tungsten light source and then passing through the optical filter was measured by an illuminometer of PI-3F type (compensated).

2) Measurement of cross-over

The sample silver halide photographic material was placed between a sheet of black paper and Radiographic intensifying screen A (containing terbium activated gadolinium oxysulfide phosphor, the main emission wavelength: 545 nm, green light). The black paper on this combination was placed to face an X-ray generator, and then exposed to X-rays. The X-ray generator used in this measurement was the same as used for the evaluation of a radiographic intensifying screen. The photographic material was exposed to X-rays in various doses, which were adjusted by varying the distance between the intensifying screen and the X-ray generator. After the exposing process was complete, the exposed material was developed in the same manner as stated in the measurement of sensitivity. The developed photographic material was divided into two sheets. The photosensitive layer on each sheet was independently peeled off. The density of the photosensitive layer having been in contact with the intensifying screen was found higher than that of the photosensitive layer in the other side (black paper side). With respect to each of the remaining layers, the characteristic curve was obtained and the average difference of the sensitivity (Δ log E) was obtained from the straight line portion (density: 0.5 to 1.0) of each characteristic curve; and then the amount of cross-over was calculated based on the estimated average difference of the sensitivity (Δ log E) in accordance with the following formula:

$$\text{Cross-over } (\%)=100/(\text{antilog}(\Delta \log E)+1).$$

The above-described procedure was repeated except that Radiographic intensifying screen A was replaced with other intensifying screens. However, the obtained values were nearly the same as obtained in the above measurement.

The calculated values of cross-over (%) are set forth in Table 3.

TABLE 3

| Photosensitive material | Sensitivity ($D_{min}$ + 0.5) (lux · second) | Cross-over (%) |
|---|---|---|
| Super HRS | 0.0076 | 18 |
| Material I | 0.0070 | 20 |
| Material II | 0.0105 | 21 |
| Material III | 0.0140 | 22 |
| Material IV | 0.0250 | 24 |

(5) Evaluation of characteristics of the combinations of silver halide photographic materials and radiographic intensifying screens 1) Measurement of sensitivity and Gamma A photographic material to be measured was sandwiched between two radiographic intensifying screens to prepare a sample combination. With respect to the prepared combination, the exposing and developing processes were carried out in the same manner as described in the measurement of sensitivity of intensifying screens.

The dose of X-rays required to Give the density of $D_{min}$+0.5 was measured and the sensitivity was defined by the reciprocal number of said required dose. The calculated sensitivity of each sample was converted to a relative value, based on the sensitivity of the combination consisting of HR-4/Super HRS being set at the value of 100 as the standard. The value of gamma was expressed by the average gamma between density of 0.8 and 1.2.

2) Measurement of MTF

A sample photographic material was placed between two sample radiographic intensifying screens, and then a radiographic image of the rectangular chart for measuring MTF described above was formed. The chart was placed in front of the aforementioned X-ray tube at a distance of 2 m. The photographic material was placed behind the chart (i.e., the material faced the tube through the chart) and the sample intensifying screen was placed behind the photographic material in close contact.

The exposed photographic material was developed by means of a roller conveyor automatic developing machine available from Fuji Photo Film Co., Ltd. (FPM-5000) in the manner described above. The dose of X-rays in exposing process was the same as described above.

The density of the radiographic image of the developed sample was measured by microdensitometer to obtain a density profile. This procedure was twenty times repeated and the obtained values were averaged to obtain the density profile on which CTF was calculated. Thereafter, the peak corresponding to the pulse of each spatial frequency in the density profile was detected to calculate the density contrast at each frequency.

The obtained density contrast was converted to the effective exposure rectangular contrast based on the independently obtained characteristic curve.

In order to derive MTF, the model MTF was assumed in accordance with the following formula:

$$MTF(v)=b(1+(au)^2)^{-1}$$

(each of "a" and "u" is a parameter).

The parameters were determined in the same manner as in the derivation of Coltman's formula. In more detail, the effective exposure rectangular contrast was expressed by MTF(v) and its components at high frequencies such as MTF(3), MTF(5), . . . , MTF(111); and then the parameters were determined so that the calculated values might correspond to the observed values. This procedure is described in detail in "HOSHASEN GAZO JYOHO KOGAKU (I)" (published by Tsusho Kenkyu-sha, 1981) by Uchida et al., pp. 171. The obtained values of the parameters were applied to the above formula, and then MTF(v) was calculated.

3) Measurement of Noise power spectrum ($NPS_0(v)$)

The measurement was carried out using the same X-ray generator as used in the measurement of MTF (in which the X-rays of 80 $KV_p$ were caused to pass through the 3 mm aluminum equivalent material and the filter of water having the path of 7 cm). The combination was placed in front of the X-ray tube at a distance of 2 m, and exposed to the X-rays. The dose of X-rays was so adjusted that the density of the image of the developed material might be 1.0. Thus, the sample for measuring $NPS_0(v)$ was prepared. The density of the image of the sample was measured by the microdensitometer on condition that the aperture was a slit of 30 μm×500 μm (scanning direction×vertical direction) and that the sampling distance was 20 μm. The number of sampling points was 8192 points/line×12 lines. The results were divided at every 256 points, and FFT processing was performed. The FFT treatment was 1320 (average) times repeated to obtain a noise power spectrum.

4) Calculation of NEQ

NEQ was calculated in accordance with the formula:

$$NEQ(v)=\{log_{10}e\times\gamma\,(MTF(v))\}^2/NPS_0(v).$$

Each obtained value was converted to a relative value, based on the NEQ value of the combination of HR-4/Super HRS being set at the value of 100 as standard. As representative values, the resulting values concerning spatial frequencies of 1 line/mm and 3 lines/mm were set forth.

5) Calculation of DQE

DQE was calculated in accordance with the formula:

$$DQE(v)=NEQ(v)/Q$$

(Q is the number of the impinged X-ray quanta.)

In the calculation, the above-obtained relative value was applied to NEQ(v). Since Q is inversely proportional to the sensitivity of the combination, the above formula can be rewritten to give the following formula:

$$\text{Relative DQE}(v)=\text{Relative NEQ}(v)\times\text{Relative sensitivity}$$

Each value obtained in accordance with the above formula was converted to a relative value, based on the DEQ value of the combination of HR-4/Super HRS being set at the value of 100 as standard. As representative values, the obtained values concerning spatial frequencies of 1 line/mm and 3 lines/mm are set forth.

6) Visual estimation

An image of the chest phantom (available from Kyoto Kagaku Co., Ltd.) was photographed in the following manner. An X-ray generator (three-phase; 12 pulse; 100 $KV_p$) equipped with a 3 mm aluminum equivalent material to make the focal spot size of the generated X-rays to be 0.6 mm×0.6 mm was used. The phantom was placed in front of the X-ray generator at a distance of 140 cm. Behind the phantom, a grid for inhibiting scattering (grid ratio: 8:1) and the combination of photographic material and intensifying screen were placed. In this arrangement, a radiographic image of the phantom was obtained.

The photographic material of the combination was developed in RD III developing solution and the aforementioned Fixing Solution F at 35° C. for 25 seconds (total processing time: 90 seconds) by the automatic developing machine (FPM-5000) in the same manner as in the measurement of photographic characteristics.

The dose of X-rays was adjusted by varying the exposure time so that the density of the determined point on the image might be 1.6. The quality of the obtained image of the chest phantom was visually estimated mainly from the viewpoint of clinical recognizability of veins in lung. The results were expressed by the marks A, B, C and D which mean "excellent", "good", "recognizable" and "not recognizable", respectively. Further, more detailed estimation was expressed using small letters "a" and "z". For instance, if two images each of which quality was assigned to the same mark A have slightly different qualities, the better one was expressed by Aa and the worse was by Az.

The results of the above measurements are set forth in Tables 4 and 5.

TABLE 4

| No. | Photosensitive Material/Screen | Sens. of Photo-sensitive Material (lux · second) | Cross-Over (%) | X-ray abs. of Screen (front/back) (%) |
|---|---|---|---|---|
| | Combination of the invention | | | |
| 1 | P.M. II/Screen A | 0.0105 | 21 | 32.8/32.8 |
| 2 | P.M. III/Screen A | 0.0140 | 22 | 32.8/32.8 |
| 3 | P.M. IV/Screen A | 0.0250 | 24 | 32.8/32.8 |
| 4 | P.M. III/Screen B | 0.0140 | 22 | 43.2/43.2 |
| 5 | P.M. IVScreen B | 0.0250 | 24 | 43.2/43.2 |
| | Combination for comparison using commercially available intensifying screen | | | |
| 6 | P.M. II/HR-8 | 0.0105 | 21 | 31.3/32.2 |
| 7 | P.M. III/HR-8 | 0.0140 | 22 | 31.3/32.2 |
| 8 | Super HRS/HR-3 | 0.0076 | 18 | 18.2/18.2 |
| 9 | Super HRS/HR-4 | 0.0076 | 18 | 22.3/23.1 |
| 10 | Super HRS/HR-8 | 0.0076 | 18 | 31.3/32.2 |

TABLE 5

| No. | Sens. ($D_{min}$ + 1.0) | γ (0.8–1.2) | DOE 1 | DOE 3 | NEO 1 (lp/mm) | NEO 3 | MTF 1 | MTF 3 | Visual Est. |
|---|---|---|---|---|---|---|---|---|---|
| | | Combination of the invention | | | | | | | |
| 1 | 159 | 2.62 | 160 | 130 | 100 | 82 | 0.71 | 0.31 | C |
| 2 | 119 | 2.80 | 155 | 128 | 130 | 107 | 0.70 | 0.31 | B |
| 3 | 67 | 2.90 | 158 | 131 | 236 | 196 | 0.69 | 0.30 | A |
| 4 | 155 | 2.80 | 182 | 105 | 117 | 68 | 0.67 | 0.25 | C |
| 5 | 87 | 2.90 | 180 | 110 | 207 | 126 | 0.67 | 0.26 | Ba |
| | Combination for comparison using commercially available intensifying screen | | | | | | | | |
| 6 | 138 | 2.62 | 150 | 95 | 109 | 69 | 0.64 | 0.22 | Cz |
| 7 | 103 | 2.80 | 145 | 95 | 141 | 92 | 0.63 | 0.21 | Cz |
| 8 | 55 | 2.55 | 72 | 89 | 131 | 162 | 0.82 | 0.51 | Ca |
| 9 | 100 | 2.55 | 100 | 100 | 100 | 100 | 0.75 | 0.37 | C |

TABLE 5-continued

| No. | Sens. ($D_{min}$ + 1.0) | γ (0.8–1.2) | DOE 1 | DOE 3 | NEO 1 (lp/mm) | NEO 3 | MTF 1 | MTF 3 | Visual Est. |
|---|---|---|---|---|---|---|---|---|---|
| 10 | 180 | 2.55 | 148 | 93 | 82 | 52 | 0.65 | 0.23 | D |

The above data indicate the following facts:

1) The combinations (1) and (2) according to the invention, in which the sample radiographic intensifying screen A is used give images having excellent characteristics in balance between the sensitivity and the image quality, as compared with the combinations (6) and (7) using a commercially available radiographic intensifying screen. In fact, the DQE values (3 lp/mm) of the images of (1) and (2) are about 1.35 times as high as those of (6) and (7). Further, the MTF values of the images of (6) and (7) are at the lowest level for diagnosis of chest and the images of veins obtained by (6) and (7) are considerably dim.
2) The combinations (4) and (5) according to the invention, which are the same combinations as (2) and (3) also according to the invention except that the intensifying screen A was replaced with the sample radiographic intensifying screen B (which absorbs X-rays more than the screen A does), give images of which DQE values (3 lp/mm) are superior to those of (2) and (3) but of which DQE values (1 lp/mm) are inferior to those of (2) and (3). Further, radiographic images given by the combinations (4) and (5) exhibit excellent graininess.
3) The combination (2) of the invention is more sensitive than the combination (9) using a commercially available radiographic intensifying screen by 19%. Further, with respect to each of DQE (3 lp/mm) and DQE (1 lp/mm), the combination (2) is superior to the combination (9) . Moreover, the radiographic image obtained by the former has less "roughness" and better recognizability of veins than that obtained by the latter.
4) The combination (2) of the invention is more than twice as sensitive as the combination (8) for comparison. Further, the radiographic image obtained by the former has better recognizability of veins than that obtained by the latter.
5) The combination (10) using a commercially available radiographic intensifying screen is very sensitive and gives high DQE, but on the other hand it gives low NEQ. According to visual observation of the radiographic image obtained, the image given by the combination (10) is too dim and too rough for medical diagnosis.
6) The combination (3) of the invention gives very high DQE, and it is more sensitive than the combination (8) for comparison by 21%. Further, the chest radiographic image given by the former exhibits excellent image quality.
7) The combination (1) of the invention gives higher DQE than the combination (9) for comparison. While the image quality of the chest radiographic image given by the former is comparable to that given by the latter, the former is about 1.5 times as sensitive as the latter.
8) The combination (8) for comparison gives very high MTF, but on the other hand low DQE is given because the combination comprises an intensifying screen which absorbs X-rays in a small amount. Besides that, the sensitivity of the combination is low. The combination gives the chest radiographic image having roughness, and therefore it is not suitable for precise diagnosis.

EXAMPLE 6

The following shows a study of the case in which the cross-over level of the silver halide photographic material used for the combination of the invention was varied.

(1) Preparation of silver halide photographic materials V, VI, VII and VIII

The procedure of the preparation of Silver halide photographic material I in Example 5 was repeated except that the upper sub-layer of the subbing layer of the support was formed by coating the following dispersion of fine crystalline dye particles, to prepare four Silver halide photographic materials V, VI, VII and VIII.

(Preparation of dispersion of fine crystalline dye particles)

A 2 liter ball mill was charged with 434 ml of water and 791 ml of 6.7% aqueous solution of surface active agent Triton-200 (TX-200), and then the following Magenta dye A was added. After 400 ml of zirconium oxide ($ZrO_2$) beads (diameter: 2 mm) was added to the mixture, the resulting mixture was pulverized for 4 days. Thereafter, 160 g of 12.5% aqueous gelatin was added. The resulting mixture was degassed, and then $ZrO_2$ beads were removed by filtration. The obtained dye dispersion was measured. According to the measurement, the diameters of pulverized dye were found to have distribution in the wide range of 0.05–1.15 μm, and the average diameter was found to be 0.37 μm.

The dye particles having the diameter of not less than 0.9 μm were removed by centrifugation to obtain the aimed dye dispersion.

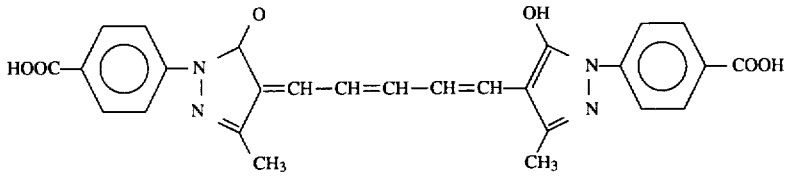

(2) Evaluation of characteristics of the silver halide photographic material

The sensitivity of the photosensitive layer on one side and the cross-over were measured and calculated in the manner described in Example 5.

The measured sensitivities and the calculated values of cross-over (%) are set forth in Table 6. In Table 6, the data of Photographic materials I–IV in Example 5 are also set forth for reference.

TABLE 6

| Photosensitive material | Sensitivity ($D_{min}$ + 0.5) (lux · second) | Cross-over (%) |
|---|---|---|
| Material I | 0.0070 | 20 |
| Material II | 0.0105 | 21 |
| Material III | 0.0140 | 22 |
| Material IV | 0.0250 | 24 |
| Material V | 0.0078 | 5.0 |
| Material VI | 0.0118 | 5.2 |
| Material VII | 0.0157 | 5.4 |
| Material VIII | 0.0280 | 6.0 |

(3) Evaluation of characteristics of the combinations of silver halide photographic materials exhibiting various cross-over values and radiographic intensifying screens Various characteristics of the combinations, each comprising one of the above-described silver halide photographic materials and Radiographic intensifying screen A, were evaluated in the manner described in Example 5. The results are set forth in Table 7. In Table 7, the marks of visual estimation stand for the same meanings as used in Table 5.

TABLE 7

| | | | DOE | | NEO | | MTF | | |
|---|---|---|---|---|---|---|---|---|---|
| P.S. Mat. | Sens. ($D_{min}$ + 1.0) | γ (0.8–1.2) | 1 | 3 | 1 (lp/mm) | 3 | 1 | 3 | Visual Est. |
| II | 159 | 2.62 | 160 | 130 | 100 | 82 | 0.71 | 0.31 | C |
| III | 119 | 2.80 | 155 | 128 | 130 | 107 | 0.70 | 0.31 | B |
| IV | 67 | 2.90 | 158 | 131 | 236 | 196 | 0.69 | 0.30 | A |
| V | 180 | 2.60 | 173 | 135 | 96 | 75 | 0.78 | 0.38 | Cz |
| VI | 139 | 2.65 | 180 | 132 | 138 | 102 | 0.78 | 0.38 | B |
| VII | 100 | 2.80 | 175 | 140 | 175 | 140 | 0.77 | 0.37 | A |
| VIII | 55 | 2.90 | 175 | 135 | 318 | 245 | 0.77 | 0.37 | Aa |

The above data indicate the following facts:

1) If the cross-over of the silver halide photographic material is made to be less than 15%, the obtained MTF and DQE are evidently improved while the sensitivity slightly lowers. According to the above data, obtained was the relation shown in FIG. 3 between the sensitivity of the combination and the image quality of the radiographic image of chest. Further, with respect to the combinations generally used for radiography shown in Tables 4 and 5 (i.e., the combination (8) for comparison: Super $HR^5$/HR-3, and the combination (9) for comparison: Super $HR^5$/HR-4; commercially available from Fuji Photo Film Co., Ltd.), the relations between the sensitivity and the image quality are also shown in FIG. 3 for reference.

Figure 3:
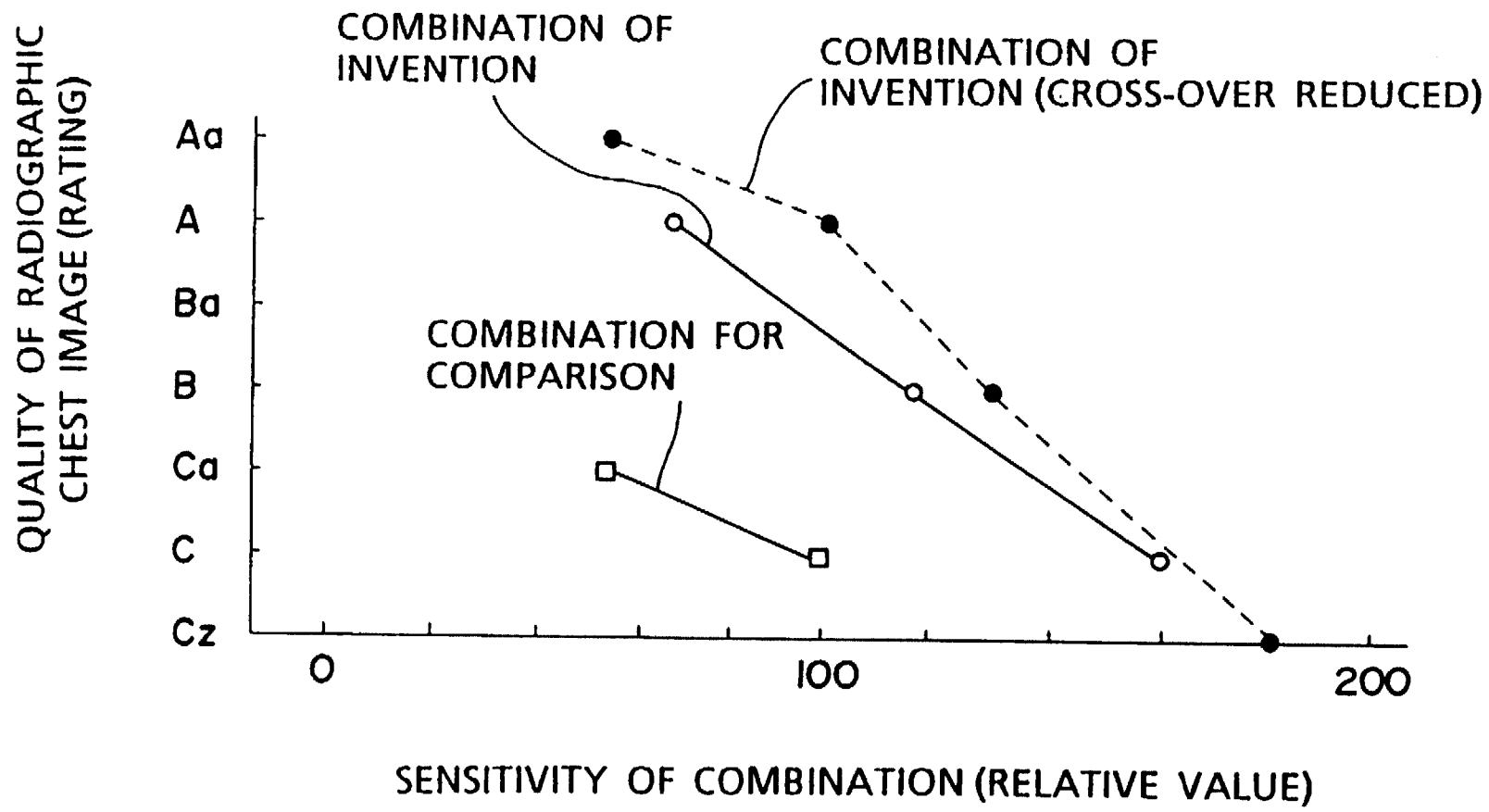
FIG. 3 shows the relations between the sensitivity and the image quality of the radiographic image of chest, with respect to combinations of a silver halide photographic material and a radiographic intensifying screen of the invention, and a combination of radiographic intensifying screens and a silver halide photographic material generally used for X-ray photography.
Figure 4:
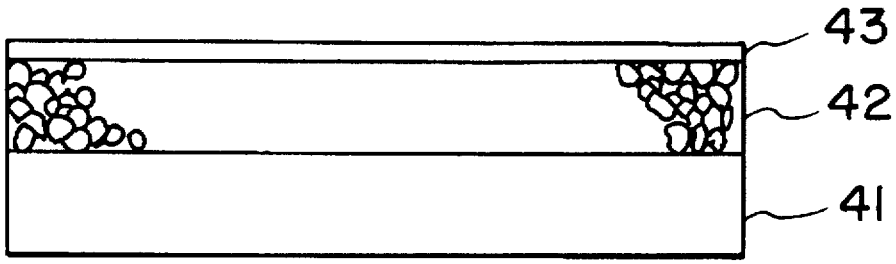
FIG. 4 schematically shows a typical constitution of the radiographic intensifying screen of the invention which comprises support 41, phosphor layer 42 and protective layer 43.
Figure 5:
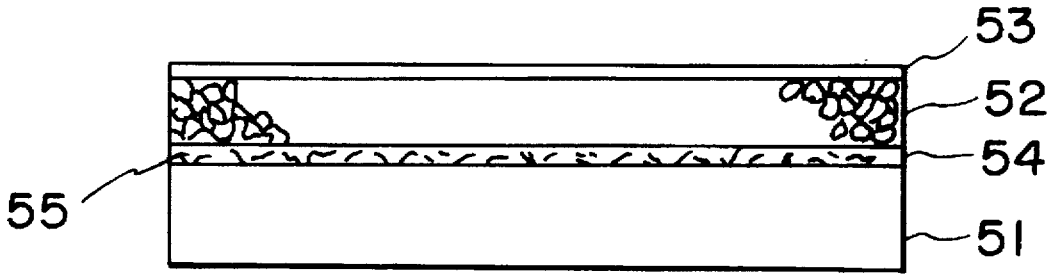
FIG. 5 schematically shows another typical constitution of the radiographic intensifying screen of the invention which comprises support 5.1, phosphor layer 52, protective layer 53, and antistatic layer 54 containing an electroconductive whisker 55.

As is evident from FIG. 3, the combination of the invention of silver halide photographic material and radiographic intensifying screen exhibits excellent characteristics in balance between the sensitivity and the image quality, as compared with the known combination of silver halide photographic material and radiographic intensifying screen generally used for radiography. In other words, the combination of the invention gives a radiographic image of better quality, under the condition that the sensitivity is kept at the same level, and on the other hand, under the condition that the image quality is kept at the same level, the radiography can be carried out at a smaller dose of X-rays.

If a silver halide photographic material showing small cross-over is applied for the combination of the invention of silver halide photographic material and radiographic intensifying screens, the above-described advantage of the invention is particularly enhanced.

EXAMPLES 7–11

(Preparation of subbing layer containing electroconductive metal oxide whisker)

The following electroconductive metal oxide whisker was added to 100 g of acrylic resin (Cryscoat P1018GS, tradename, available from Dainippon Ink and Chemicals Co., Ltd.). To the mixture was further added methyl ethyl ketone. The resulting mixture was stirred to give a dispersion having a viscosity of 3–10 PC (25° C.). The resulting dispersion was coated on the support to give the following coating amount.

Example 7: ZnO whisker (Panatetra: tradename, available from Matsushita Industrial Machine Co., Ltd.) Amount of addition: 200 g, Coating amount: 25 g/$m^2$ Example 8: ZnO whisker (Panatetra: tradename, available from Matsushita Industrial Machine Co., Ltd.) Amount of addition: 350 g, Coating amount: 25 g/$m^2$ Example 9: ZnO whisker (Panatetra: tradename, available from Matsushita Industrial Machine Co., Ltd.) Amount of addition: 100 g, Coating amount: 25 g/$m^2$ Example 10: ZnO whisker (Panatetra: tradename, available from Matsushita Industrial Machine Co., Ltd.) Amount of addition: 100 g, Coating amount: 50 g/$m^2$ Example 11: $K_2O{\cdot}nTiO_2$ whisker (Densitol BK: tradename, available from Ohtsuka Chemical Co., Ltd.) Amount of addition: 100 g, Coating amount: 25 g/$m^2$ The procedures for obtaining radiographic images were repeatedly performed using a radiographic film and the radiographic intensifying screens of Examples 7 to 11. In these procedures, dust deposited on the protective layer was observed. By this observation, it was confirmed that the dust was less observed than the case using a radiographic intensifying screens of Example 1 having no subbing layer of the electroconductive material. Further, it was confirmed that dust and stain which were deposited on the protective layer after additional radiographic procedures could be easily removed by wiping the surface of the protective layer with a cloth containing a solvent such as ethanol or isopropyl alcohol.

Moreover, it was confirmed that no static marks (which are sometimes produced by discharge of deposited static electricity and lower visual recognizability of an obtained radiographic image) were observed on the obtained radiographic images even after the repeated procedures, when the radiographic intensifying screens of Examples 7 to 11 were employed.

We claim:

1. A radiographic intensifying screen comprising a support, a phosphor layer and a protective layer in order, wherein the protective layer is formed on the phosphor layer by coating a fluoro-resin on the phosphor to give a coated layer having a thickness of less than 5 μm, said screen absorbing X-rays of 80 $KV_p$ in an amount of not less than 25% and showing contrast transfer function values of at least 0.79 and at least 0.36 at spatial frequencies of 1 lp/mm and of 3 lp/mm, respectively.

2. The radiographic intensifying screen as defined in claim 1, wherein the phosphor layer contains a thermoplastic elastomer as a binder and is prepared by compressing a coated layer comprising a phosphor and the binder.

3. The radiographic intensifying screen as defined in claim 1, wherein the protective layer is formed by coating a fluoro-resin and an oligomer having a polysiloxane structure on the phosphor layer.

4. The radiographic intensifying screen as defined in claim 1, wherein an electroconductive whisker is contained in at least one of the support, phosphor layer and protective layer.

5. The radiographic intensifying screen as defined in claim 1, wherein an antistatic layer containing an electroconductive whisker is comprised.

6. The radiographic intensifying screen as defined in claim 1, wherein an antistatic layer containing an electroconductive whisker is provided between the support and the phosphor layer.

7. The radiographic intensifying screen as defined in claim 1, wherein the protective layer is formed on the phosphor layer by coating a solution of the fluoro-resin in an organic solvent and evaporating the solvent to give a coated layer having a thickness of less than 5 μm.

* * * * *